US011166563B2

(12) United States Patent
Chen

(10) Patent No.: US 11,166,563 B2
(45) Date of Patent: Nov. 9, 2021

(54) TABLET

(71) Applicant: ATEC INTERNATIONAL TEAM CO., LTD., Luzhu Township, Taoyuan County (TW)

(72) Inventor: Te-Chun Chen, Luzhu Township, Taoyuan County (TW)

(73) Assignee: ATEC INTERNATIONAL TEAM CO., LTD., Luzhu Township, Taoyuan County (TW)

( * ) Notice: Subject to any disclaimer, the term of this patent is extended or adjusted under 35 U.S.C. 154(b) by 0 days.

(21) Appl. No.: 16/909,450

(22) Filed: Jun. 23, 2020

(65) Prior Publication Data

US 2021/0045536 A1 Feb. 18, 2021

(30) Foreign Application Priority Data

Aug. 16, 2019 (TW) ..... 108129311

(51) Int. Cl.

| | |
|---|---|
| ***A47B 39/00*** | (2006.01) |
| ***A47B 39/02*** | (2006.01) |
| ***A47C 7/70*** | (2006.01) |
| ***A47C 7/34*** | (2006.01) |
| ***A47C 7/54*** | (2006.01) |
| ***A47C 7/00*** | (2006.01) |

(52) U.S. Cl.

CPC ..... *A47C 7/70* (2013.01); *A47B 39/00* (2013.01); *A47B 39/02* (2013.01); *A47C 7/006* (2013.01); *A47C 7/34* (2013.01); *A47C 7/541* (2018.08)

(58) Field of Classification Search

CPC ..... A47C 7/006; A47C 7/34; A47C 7/541; A47C 7/70; A47B 39/00; A47B 39/02

USPC ..... 297/160, 161, 162, 170, 172

See application file for complete search history.

(56) References Cited

U.S. PATENT DOCUMENTS

| | | | | | |
|---|---|---|---|---|---|
| 4,575,149 | A * | 3/1986 | Forestall | A47B 23/02 | 297/162 X |
| 5,169,210 | A * | 12/1992 | Fricano | A47C 7/70 | 297/170 X |
| 5,653,499 | A * | 8/1997 | Goodall | A47C 7/70 | 297/170 |
| 5,865,124 | A * | 2/1999 | Wroe | A47C 7/624 | 297/170 X |
| 6,142,559 | A * | 11/2000 | Sorel | A47C 7/68 | 297/135 |
| 6,422,646 | B1 * | 7/2002 | McNally | A47C 7/70 | 297/170 |

(Continued)

*Primary Examiner* — Rodney B White

(74) *Attorney, Agent, or Firm* — Muncy, Geissler, Olds & Lowe, P.C.

(57) ABSTRACT

A tablet including a plate member, a support rod and a positioning member is revealed. The plate member has a top cover, a bottom cover, and a first slide member. By the movable engagement of a rack with a damper, the top and the bottom covers slide relative to the first slide member. The support rod includes an upper end for supporting the plate member and a lower end assembled on a chair, a bed, a sofa, a table, a tray with wheels or a multi-seater chair. The upper end forms a rotary shaft which is inserted through an insertion hole of the bottom cover to be fixed on the first slide member. The positioning member includes a movable locking pin member. The angle of the plate member can be adjusted by the locking pin member being released from or locked into a positioning hole on the rotary shaft.

15 Claims, 28 Drawing Sheets

(56) References Cited

U.S. PATENT DOCUMENTS

| | | | | |
|---|---|---|---|---|
| 6,776,452 | B2 * | 8/2004 | Onishi | A47B 83/02 297/170 |
| 9,044,099 | B2 | 6/2015 | Bouche | |
| 9,277,825 | B2 * | 3/2016 | Corcorran | A47C 7/68 |
| 9,693,625 | B2 * | 7/2017 | Lu | A47C 3/18 |
| 9,962,003 | B2 * | 5/2018 | Corcorran | A47B 83/02 |
| 10,045,627 | B2 * | 8/2018 | Simon | A47C 7/70 |
| 10,264,893 | B2 * | 4/2019 | Keilhauer | A47C 3/18 |
| 10,966,534 | B2 * | 4/2021 | Keilhauer | A47C 7/006 |
| 2008/0231091 | A1 * | 9/2008 | Goranson | A47C 7/62 297/135 |
| 2011/0187164 | A1 * | 8/2011 | Corcorran | A47B 83/02 297/170 |
| 2012/0126587 | A1 * | 5/2012 | Seo | A47C 7/705 297/173 |
| 2012/0267923 | A1 * | 10/2012 | Bouche | A47C 7/626 297/161 |
| 2016/0338495 | A1 * | 11/2016 | Purintun | A47C 7/004 |

* cited by examiner

TABLET

BACKGROUND OF THE INVENTION

The present invention relates to a tablet, especially to a tablet able to be assembled on one side of a chair, a bed, a sofa, a table, a tray with wheels or a multi-seater chair, which is easy to use and able to be adjusted to a variety of positions or angles conveniently.

Generally, a piece of furniture such as a chair (especially the one for students in the classroom), a bed or a sofa is not provided with a tablet (such as a writing tablet) so that it is inconvenient to use when users sit thereon and want to write something, use electronics or even place objects such as drink ups on there. Refer to U.S. Pat. No. 9,044,099 "CHAIR WITH ADJUSTABLE TABLET", this chair is designed with a tablet. However, the writing tablet revealed has the following advantages: (1) The writing tablet is designed to be mounted to a specific chair correspondingly. Thus the applications of the writing tablet are limited and this is not good for both manufacturers and consumers. (2) The writing tablet is able to slide laterally with respect to a tablet arm by a slide member slidable within a sliding slot. The friction generated during sliding is increased and this has negative effect on the users'/consumers' operation. The respective components are easily damaged due to the friction. (3) The writing tablet is supported on a tablet arm and able to slide transversely lateral with respect to the tablet arm. Yet there is no positioning device between the writing tablet and the tablet arm so that the writing tablet is unable to be positioned relative to the tablet arm after the adjustment. Users are unable to position the writing tablet at the angle/position they needed and this causes some inconvenience to users. (4) The writing tablet users slide transversely by two sets of bearings (such as an upper bearing 66 and a lower bearing 68 shown in FIG. 3). Such mounting arrangement is complicated and easily damaged. The design is also not suitable for the manufacturer's/consumer/s assembly and cost reduction is unable to be achieved.

Thus there is room for improvement and there is a need to provide a novel tablet that not only overcomes the above shortcomings but also has more applications such as a bed, a sofa, a table, a tray with wheels or a multi-seater chair besides being applied to the chair.

SUMMARY OF THE INVENTION

Therefore it is a primary object of the present invention to provide a tablet able to be assembled on one side of a chair, a bed, a sofa, a table, a tray with wheels or a multi-seater chair, which is easy to use and able to be adjusted to a variety of angles or positions conveniently. The tablet includes a support rod, a plate member, and a positioning member. The support rod consists of an upper end for supporting the plate member and a lower end for being assembled on one side of the chair, the bed, the sofa, the table, the tray with wheels or the multi-seater chair. The positioning member includes a movable locking pin member. When the movable locking pin member is operated to be extended and locked into/or retracted and released from a positioning hole on the rotary shaft, the plate member can be rotated horizontally for adjusting an angle between the plate member and upper end of the support rod and then positioned at the angle later.

In order to achieve the above object, a tablet according to the present invention includes a plate member, a support rod and a positioning member. The support rod includes an upper end and a lower end extended downward from the upper end for a certain length. The upper end which forms a rotary shaft is used for supporting the plate member thereover and at least one positioning hole is formed on the rotary shaft. The plate member consists of a top cover, a first slide member, and a bottom cover. The top cover and the bottom cover are arranged vertically and assembled with each other to form one part which is moved forward and backward with respect to the first slide member in the widthwise direction of the plate member. The top cover has a first receiving space for mounting the first slide member and the bottom cover while the first slide member is provided with a second receiving space. The bottom cover is provided with a widthwise first sliding slot and a widthwise long insertion hole arranged at the bottom of the first sliding slot. The first slide member is able to slide forward and backward in the first sliding slot.

The rotary shaft formed on the upper end of the support rod is inserted through the insertion hole of the bottom cover from bottom to top to be connected to and fixed on the first slide member. The plate member further includes at least one damper which is mounted in a mounting slot on the first slide member. Each damper is movably engaged with a first rack arranged along the first sliding slot of the bottom cover. By the movable engagement of the first rack with the damper, the top cover and the bottom cover of the plate member can slide forward and backward with respect to the first slide member in the widthwise direction of the plate member with damping. The plate member further includes two shield sets which are located between the first slide member and the first sliding slot of the bottom cover and are respectively disposed on two ends of the first sliding slot in the lengthwise direction of the first sliding slot, symmetrical to each other. The shield sets can be moved forward and backward in the widthwise direction of the bottom cover to cover the insertion hole of the bottom cover. Each shield set is composed of a first shield and a second shield. The first shield has a first slide-way portion and a first slide rail portion while the second shield has a second slide-way portion and a second slide rail portion. In the shield sets, the first slide rail portion of the first shield is movably connected to the second slide rail portion of the second shield so that the first shield and the second shield can slide with respect to each other for being extended or overlapped.

Two first sliding blocks are disposed on two ends of each of two opposite sides of the bottom surface of the first slide member in the lengthwise direction of the first slide member and are movably inserted into the first slide-way portions of the first shield correspondingly from top to bottom. Two second sliding blocks are arranged at two ends of each of two opposite sides of the inner surface of the first sliding slot in the lengthwise direction of the first sliding slot and are movably inserted into the second slide-way portion of the second shield correspondingly from bottom to top. When the first shield and the second shield in one of the two shield sets are driven to slide and extend with respect to each other, the first shield and the second shield in the other shield set are driven to slide and overlap with each other. Thereby the first shield and the second shield of the respective shield sets synchronously slide forward/backward to extend completely or overlap with each other for shielding the insertion hole of the bottom plate when the top cover and the bottom cover are moved forward/backward with respect to the first slide member in the plate member. The positioning member is mounted in the second receiving space of the first slide member and is provided with a movable locking pin member. The movable locking pin member can be operated to be extended and locked into/or retracted and released from the positioning hole on the rotary shaft formed on the upper end of the support rod. While the locking pin member is operated to be retracted and released from the positioning hole on the rotary shaft of the support rod, the plate member can be operated and rotated horizontally for adjusting or selecting the angle of the plate member with respect to the upper end of the support rod. When the locking pin member is operated to be extended and locked into the positioning hole on the rotary shaft of the support rod, the plate member is positioned at the angle relative to the support rod at that time.

DETAILED DESCRIPTION OF THE PREFERRED EMBODIMENTS

With reference to figures, the structure and technical features of the present invention are described in details by the following embodiments. The respective figures are used to show structure and related functions of the present invention and the sizes of the respective components are not drawn according to the actual proportion.

Figure 1:
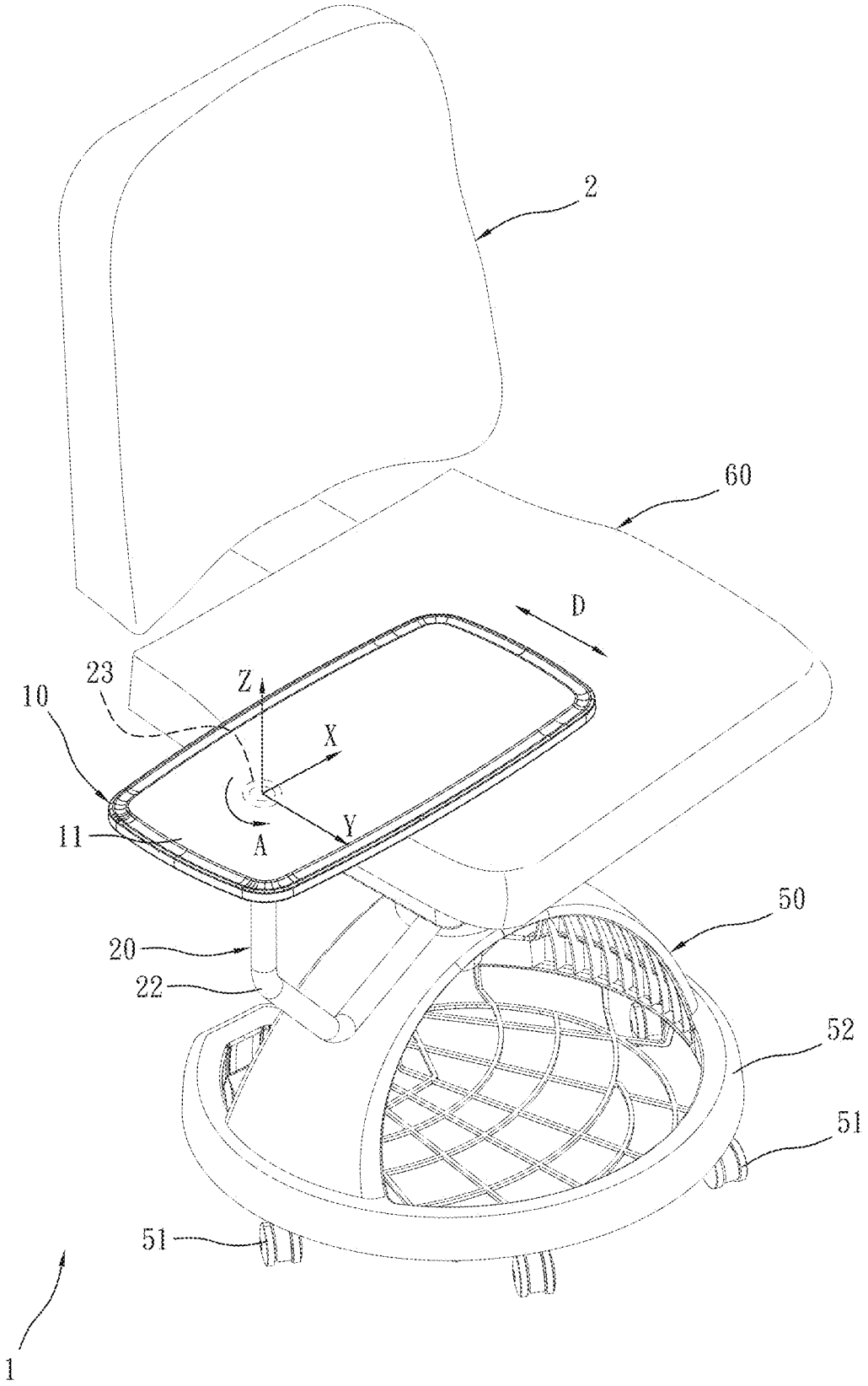
FIG. 1 is a perspective view of an embodiment of a tablet (being assembled on a chair for right-handers) according to the present invention.
Figure 30:
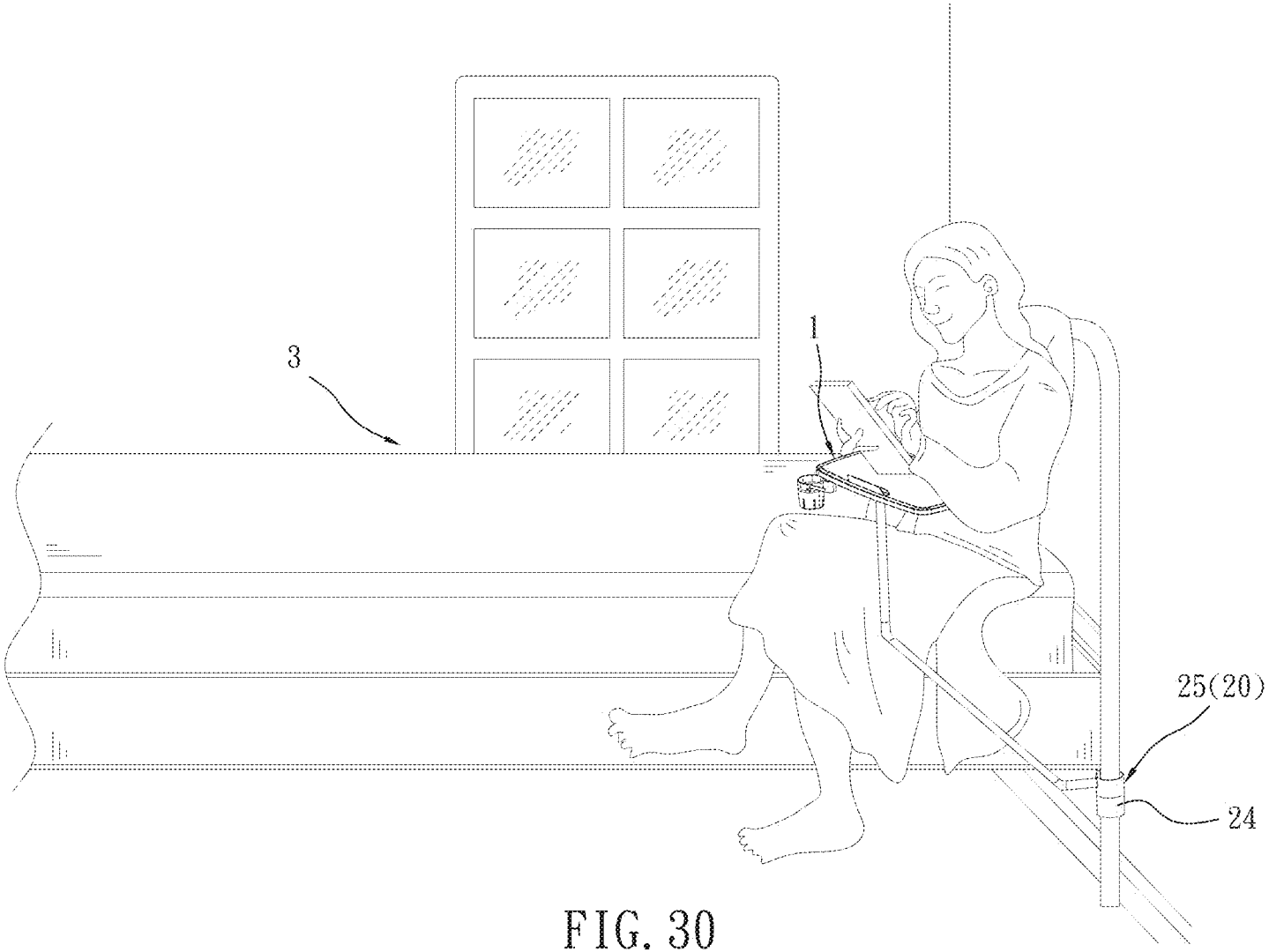
FIG. 30 is a further embodiment (used in a bed) according to the present invention.
Figure 31:
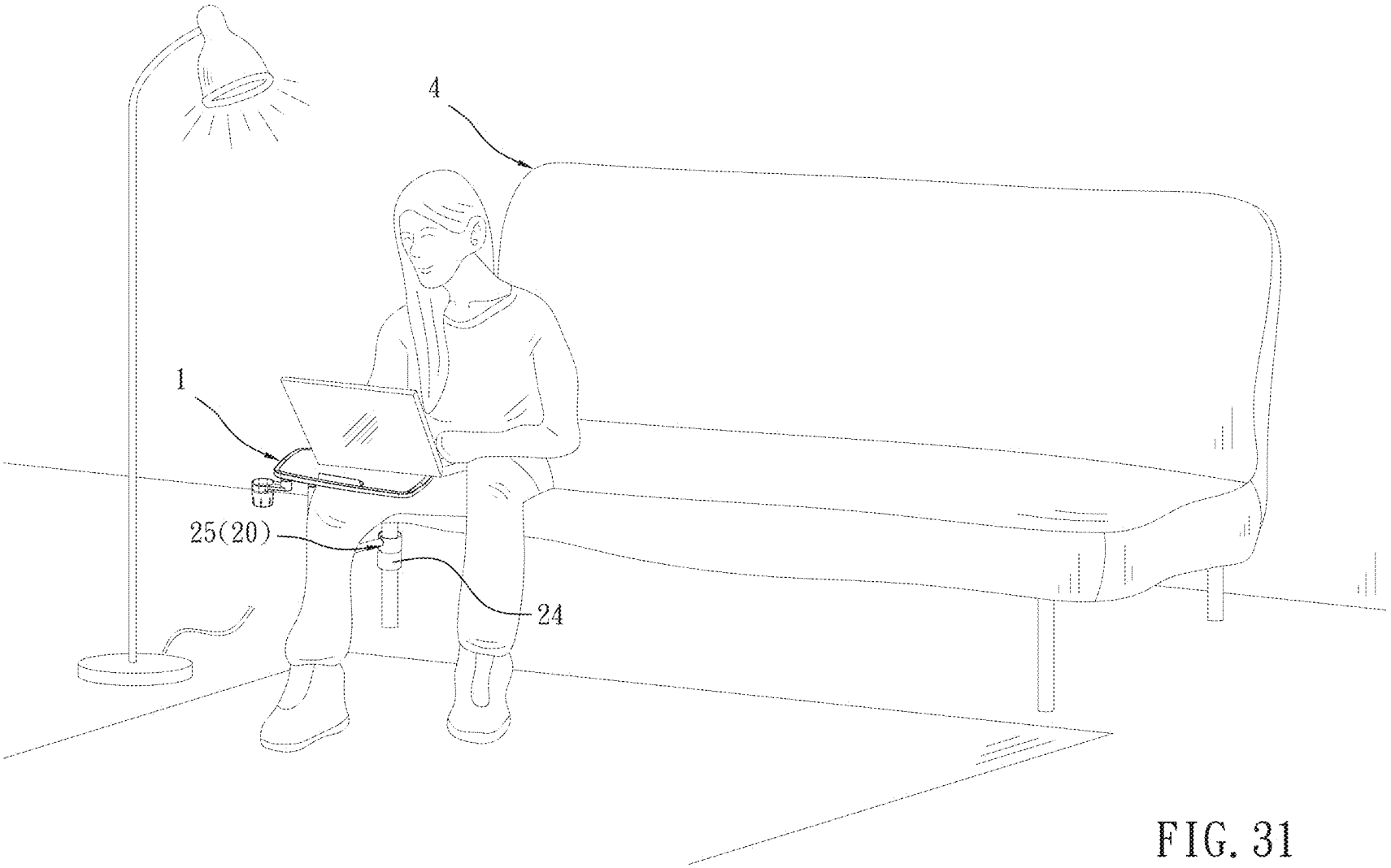
FIG. 31 is a further embodiment (used in a sofa) according to the present invention.
Figure 32:
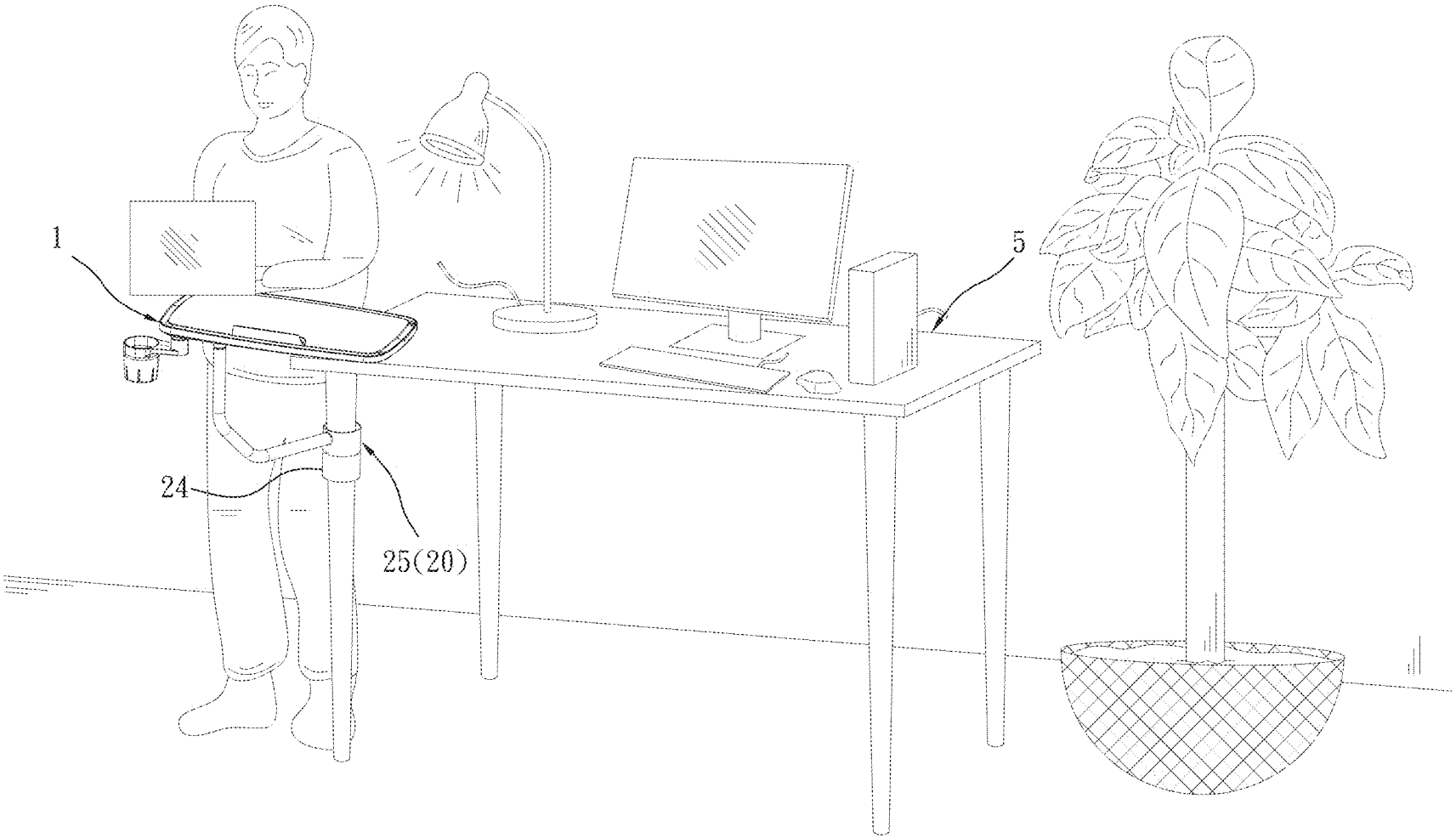
FIG. 32 is a further embodiment (used in a table) according to the present invention.
Figure 33:
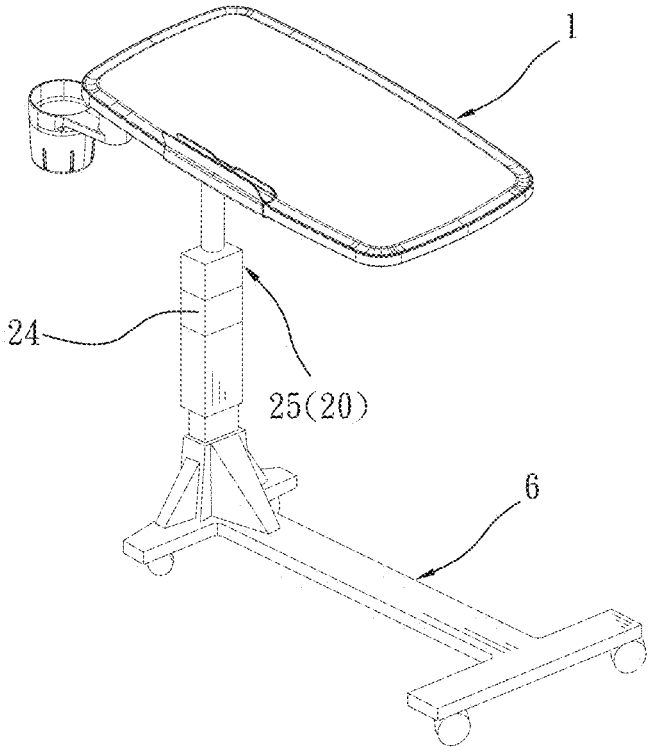
FIG. 33 is a further embodiment (used in a tray with wheels) according to the present invention.
Figure 34:
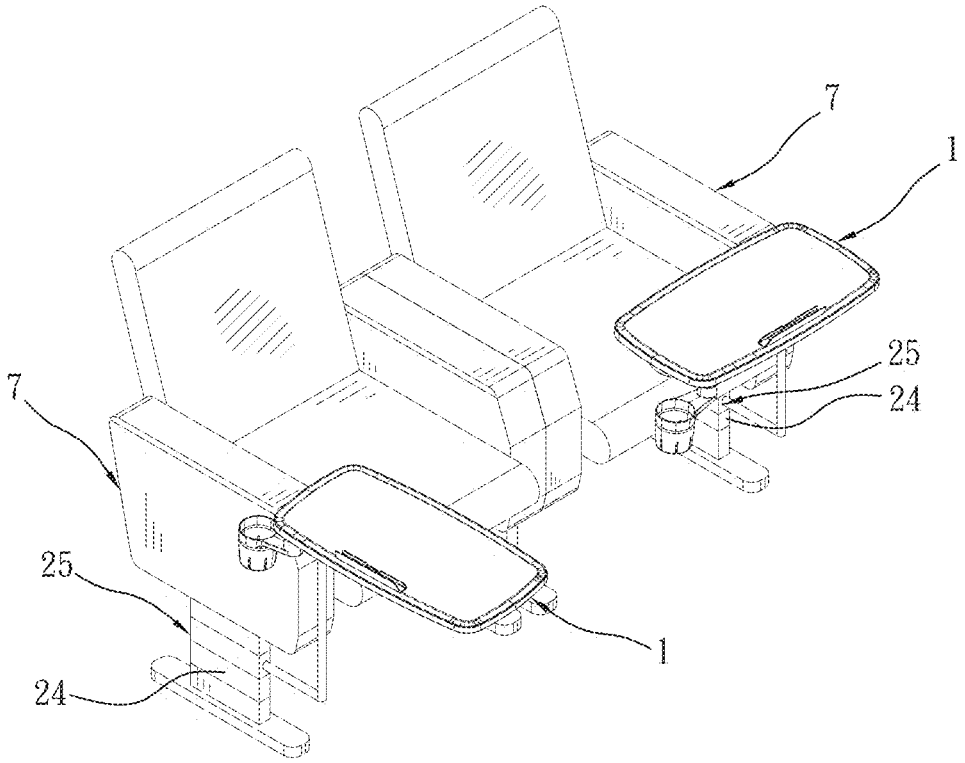
FIG. 34 is a further embodiment (used in a multi-seater chair) according to the present invention.

Refer to figures, a tablet 1 according to the present invention is able to be assembled on one side of a chair 2 (as shown in FIG. 1), a bed 3 (as shown in FIG. 30), a sofa 4 (as shown in FIG. 31), a table 5 (as shown in FIG. 32), a tray with wheels 6 (as shown in FIG. 33) or a multi-seater chair 7 (as shown in FIG. 34) for users to use the tablet for multiple tasks. While the tablet 1 being disposed on the above pieces of furniture, the tablet 1 further includes a base 24 being arranged at a leg of the bed 3, the sofa 4, the table 5, the tray with wheels 6 or the multi-seater chair 7. Thereby the tablet 1 can be adjusted to the position the user requires by being rotated around the base 24, as shown in FIG. 30-34.

Take a tablet 1 of the present invention being applied to a chair 2. In the embodiments shown in FIG. 1-29, the tablet 1 includes a plate member 10, a support rod 20 and a positioning member 30. A sleeve 21 is formed at a lower end of the support rod 20 while a rod member 22 is disposed between the sleeve 21 and a rotary shaft 23. The sleeve 21 is pivotally connected to a lower part of a chair 2 so that the plate member 10 can be rotated a certain angle horizontally around the chair 2. Thus the distance between the plate member 10 and the chair 2 is able to be adjusted by sliding of a first slide member 12.

Figure 2:
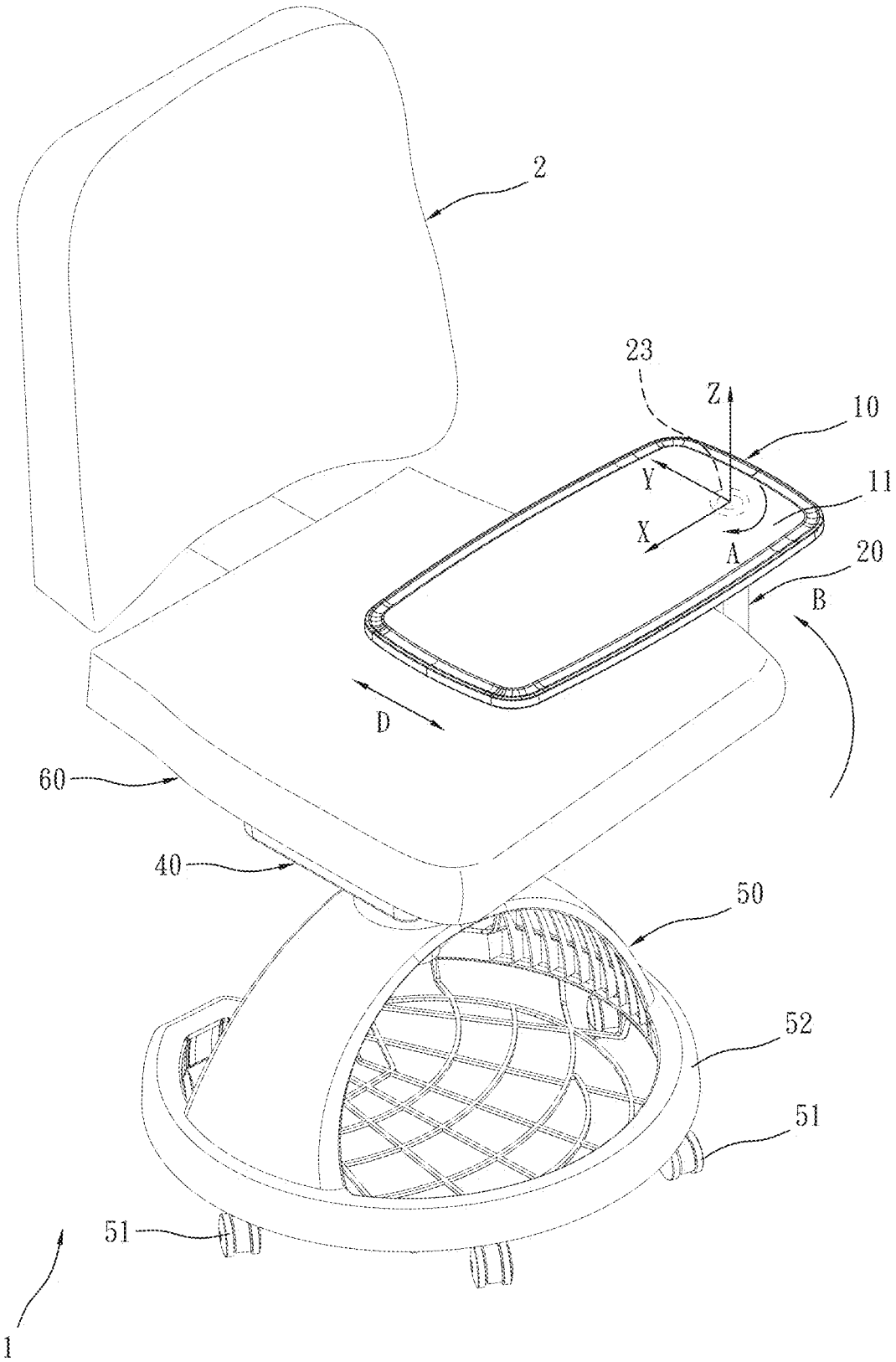
FIG. 2 is a perspective view of the embodiment in FIG. 1 being assembled on a chair for left-handed users according to the present invention.
Figure 3:
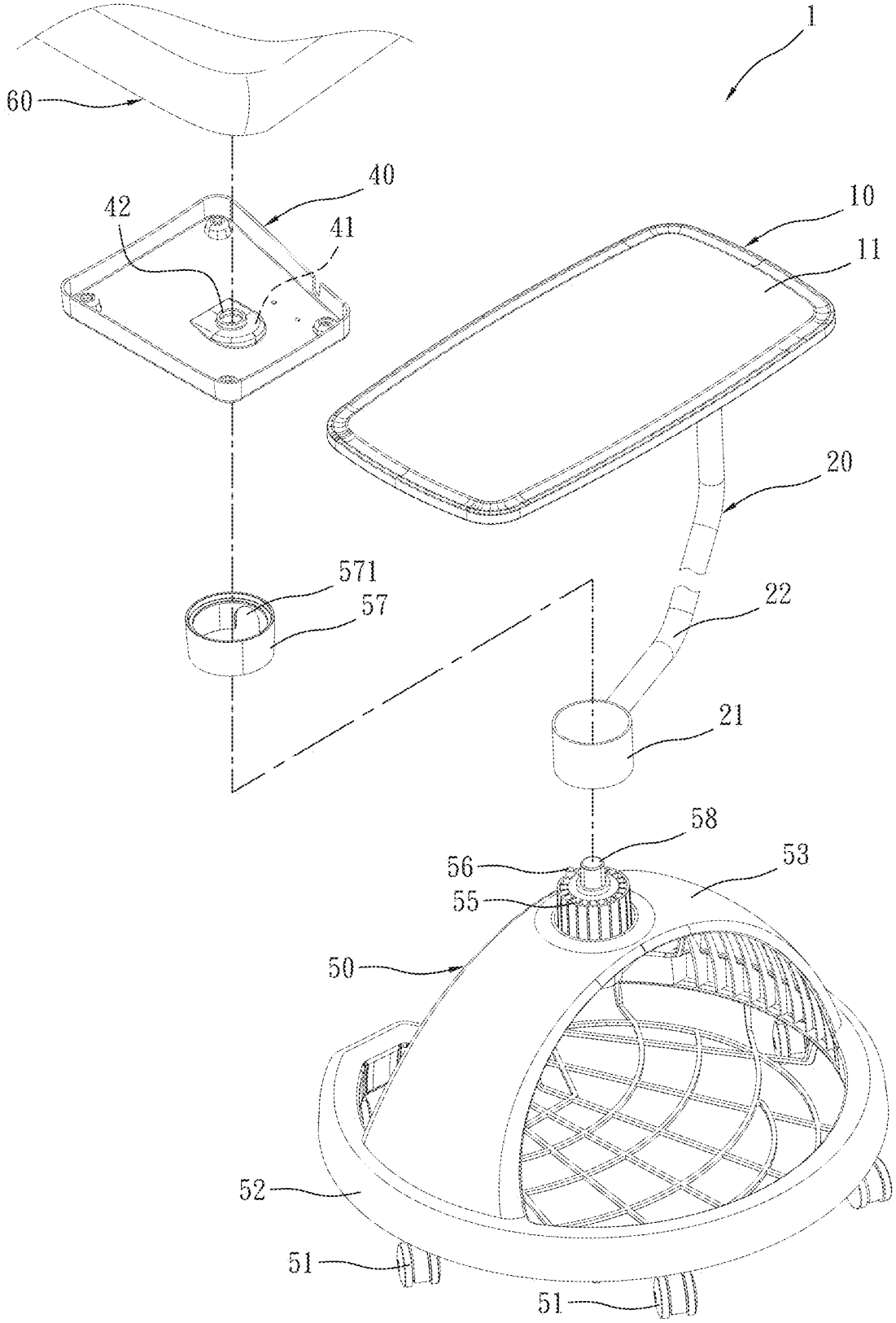
FIG. 3 is an explosive view of the embodiment in FIG. 2 according to the present invention.

As shown in FIG. 1-3, the lower part of the chair 2 further includes a seat 60 and a chair base 50. The seat 60 is supported by the chair base 50 while the support rod 20 is not only rotatably disposed between the chair base 50 and the seat 60 for left-handers or right-handers to use, but also extended and inclined upward for supporting the plate member 10, as shown in FIG. 3. The sleeve 21 is pivotally connected to the chair base 50 of the chair 2 so that the support rod 20 is rotatable with respect to the chair base 50, as the arrow B indicates in FIG. 2.

Figure 4:
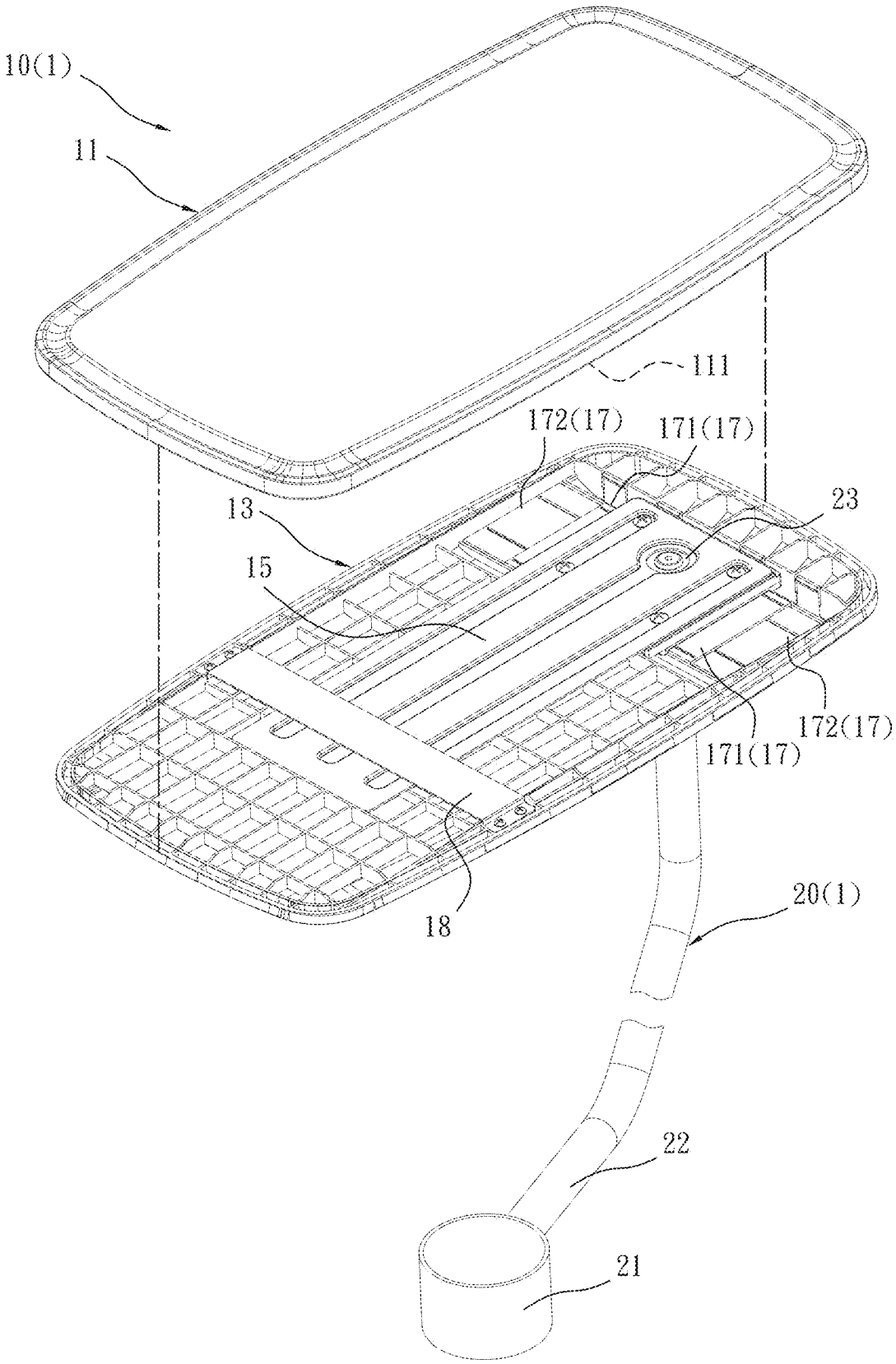
FIG. 4 is a partial enlarged explosive view of the embodiment in FIG. 3 according to the present invention.
Figure 5:
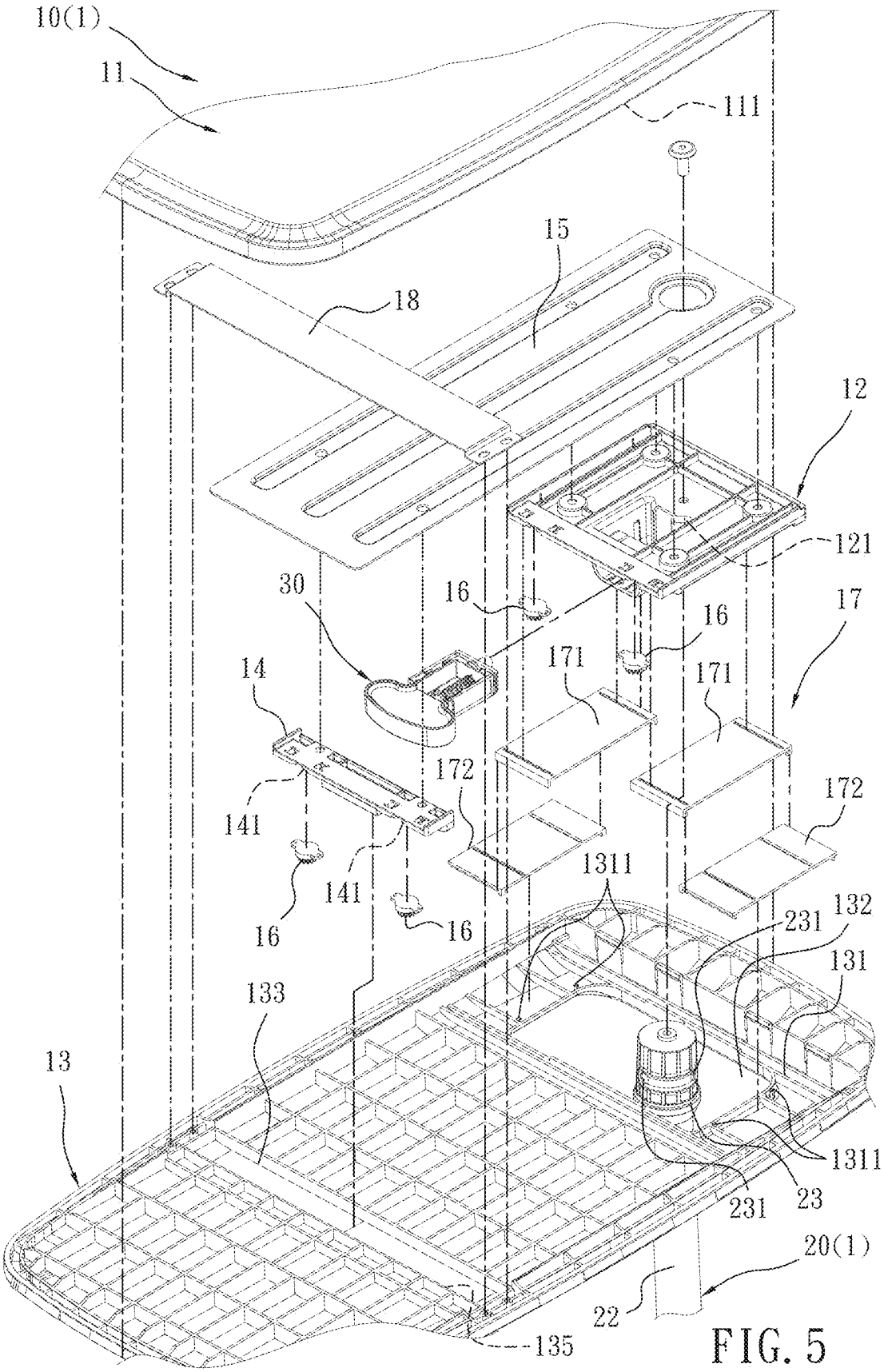
FIG. 5 is a partial enlarged explosive view of the embodiment in FIG. 4 according to the present invention.
Figure 6:
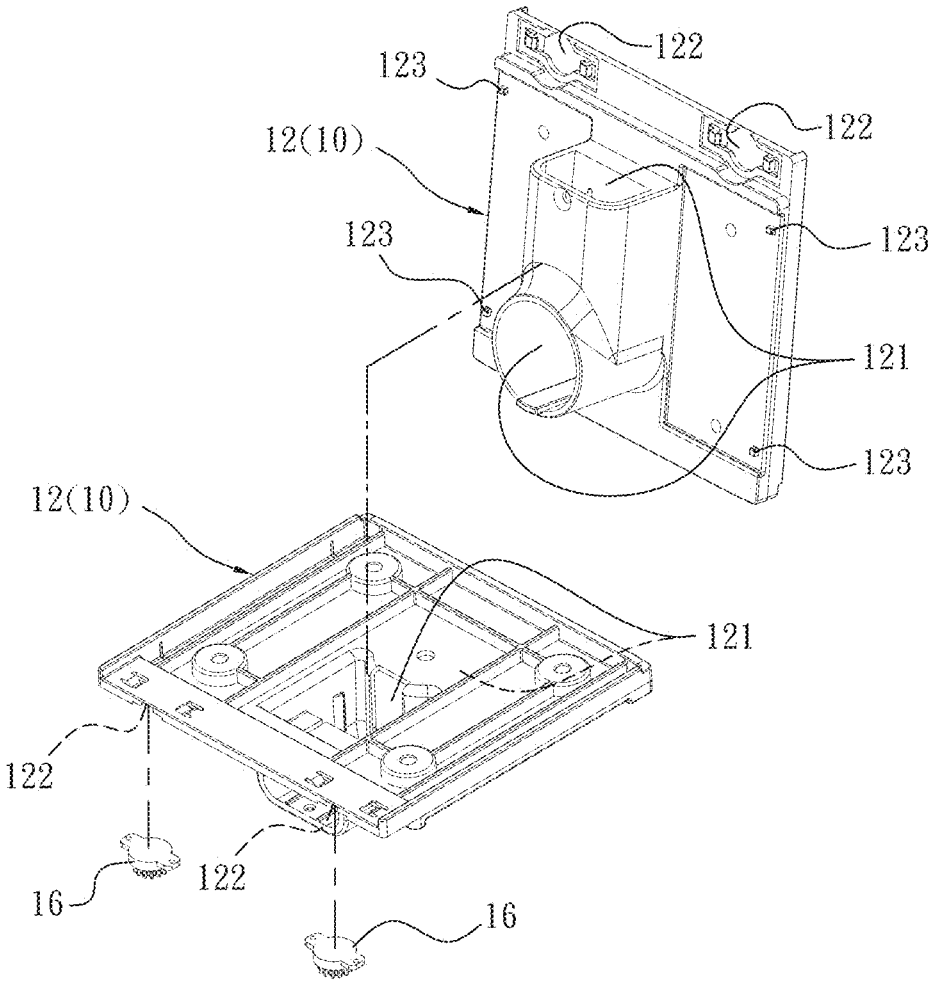
FIG. 6 is a partial enlarged explosive view of a first slide member and dampers of the embodiment in FIG. 5 according to the present invention.
Figure 7:
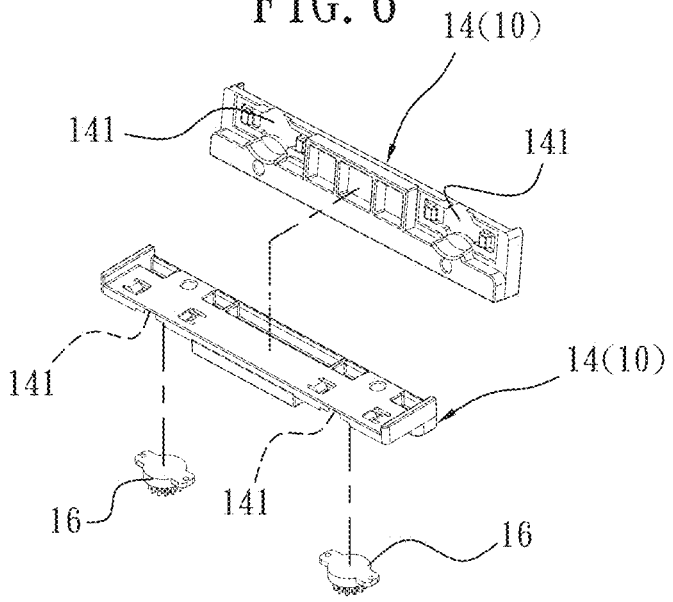
FIG. 7 is a partial enlarged explosive view of a second slide member and dampers of the embodiment in FIG. 5 according to the present invention.
Figure 8:
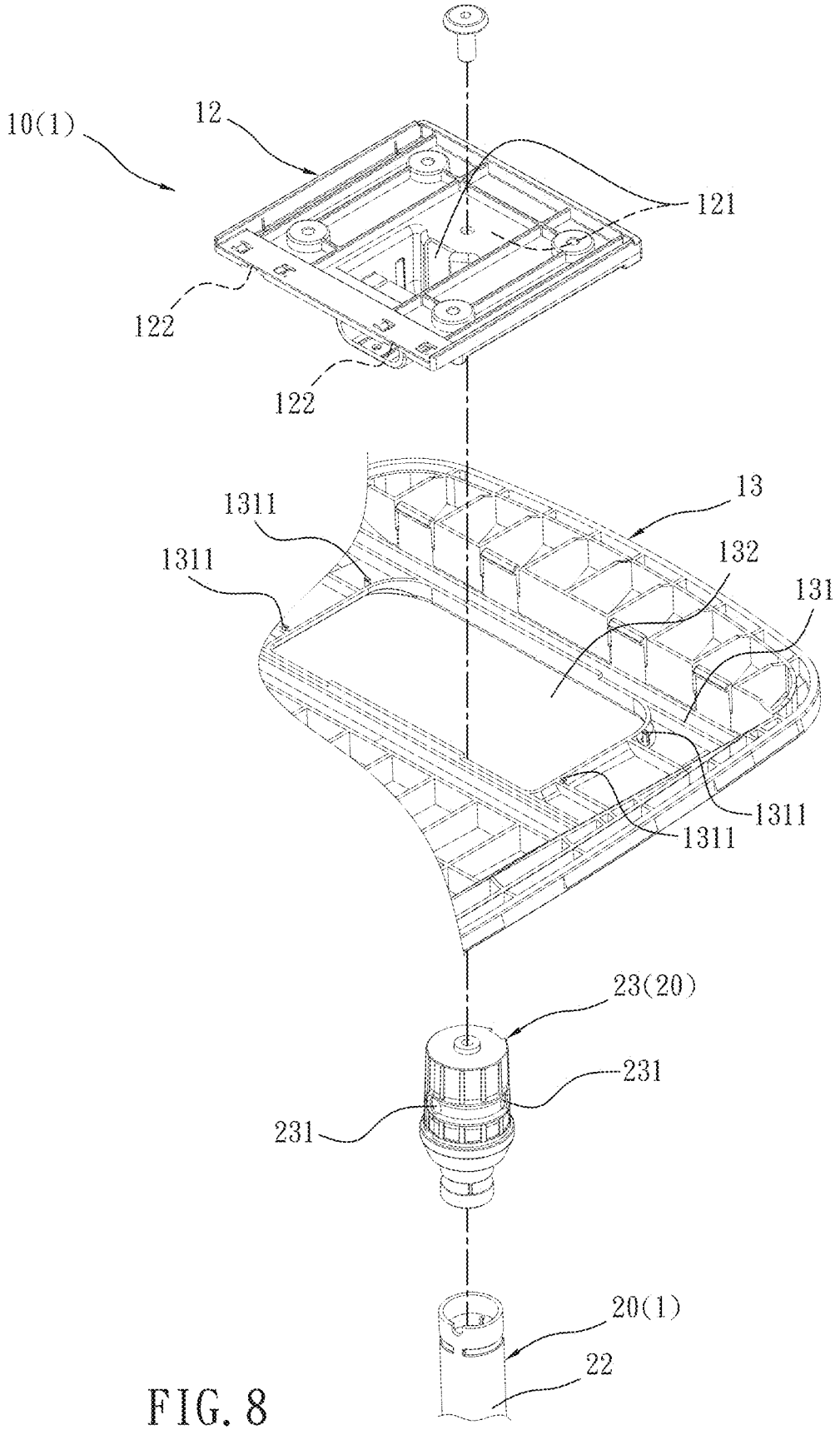
FIG. 8 is a partial enlarged explosive view of a first slide member, a bottom cover, a rotary shaft and a rod member of an embodiment according to the present invention.
Figure 9:
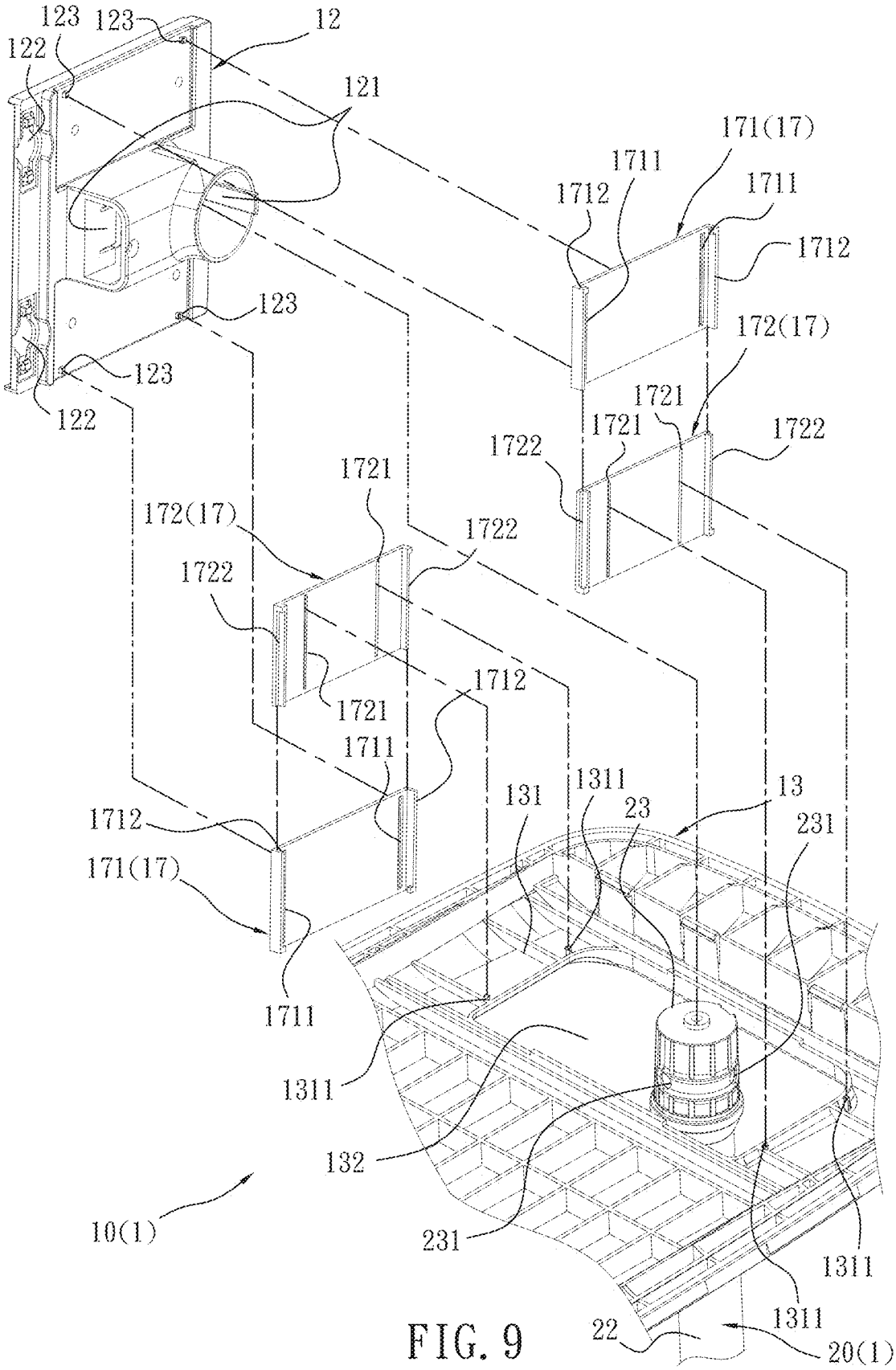
FIG. 9 is a partial enlarged explosive view of a first slide member, a shield set and a bottom plate of an embodiment according to the present invention.

Refer to FIG. 4 and FIG. 5, the plate member 10 consists of a top cover 11, a first slide member 12, and a bottom cover 13. The top cover 11 and the bottom cover 13 are arranged vertically and assembled with each other to form one part which is moved forward and backward with respect to the first slide member 12 in the widthwise direction of the plate member 10. The top cover 11 has a first receiving space 111 for mounting the first slide member 12 and the bottom cover 13 while the first slide member 12 is provided with a second receiving space 121, as shown in FIG. 6. The bottom cover 13 is provided with a first sliding slot 131 disposed in the widthwise direction of the bottom cover 13 and a long insertion hole 132 arranged at the bottom of the first sliding slot 131 along the widthwise direction of the bottom cover 13. The first slide member 12 is able to slide forward and backward in the first sliding slot 131. The rotary shaft 23 formed on the upper end of the support rod 20 is inserted through the insertion hole 132 of the bottom cover 13 from bottom to top to be connected to and fixed on the first slide member 12, as shown in FIG. 5 and FIG. 9. The plate member 10 further includes at least two dampers which are mounted in respective mounting slots 122 on the first slide member 12, as shown in FIG. 6. Each damper 16 is movably engaged with a first rack 134 arranged along the first sliding slot 131 of the bottom cover 13. By the movable engagement of the first rack 134 with the damper 16, the top cover 11 and the bottom cover 13 of the plate member 10 are able to slide forward and backward with respect to the first slide member 12 in the widthwise direction of the plate member 10 with damping (which slows the motion over time gradually), as the arrow D indicates in FIG. 14.

As shown in FIG. 9, the plate member 10 further includes two shield sets 17 which are located between the first slide member 12 and the first sliding slot 131 of the bottom cover 13 and are respectively disposed on two ends of the first sliding slot 131 in the lengthwise direction of the first sliding slot 131, symmetrical to each other. The shield sets 17 can be moved forward and backward in the widthwise direction of the bottom cover 13 to cover the insertion hole 132 of the bottom cover 13 thereunder. Each shield set 17 is composed of a first shield 171 and a second shield 172. The first shield 171 has a first slide-way portion 1711 and a first slide rail portion 1712 while the second shield 172 has a second slide-way portion 1721 and a second slide rail portion 1722. In the shield sets 17, the first slide rail portion 1712 of the first shield 171 is movably connected to the second slide rail portion 1722 of the second shield 172 so that the first shield 171 and the second shield 172 can slide with respect to each other for being extended or overlapped.

Figure 12:
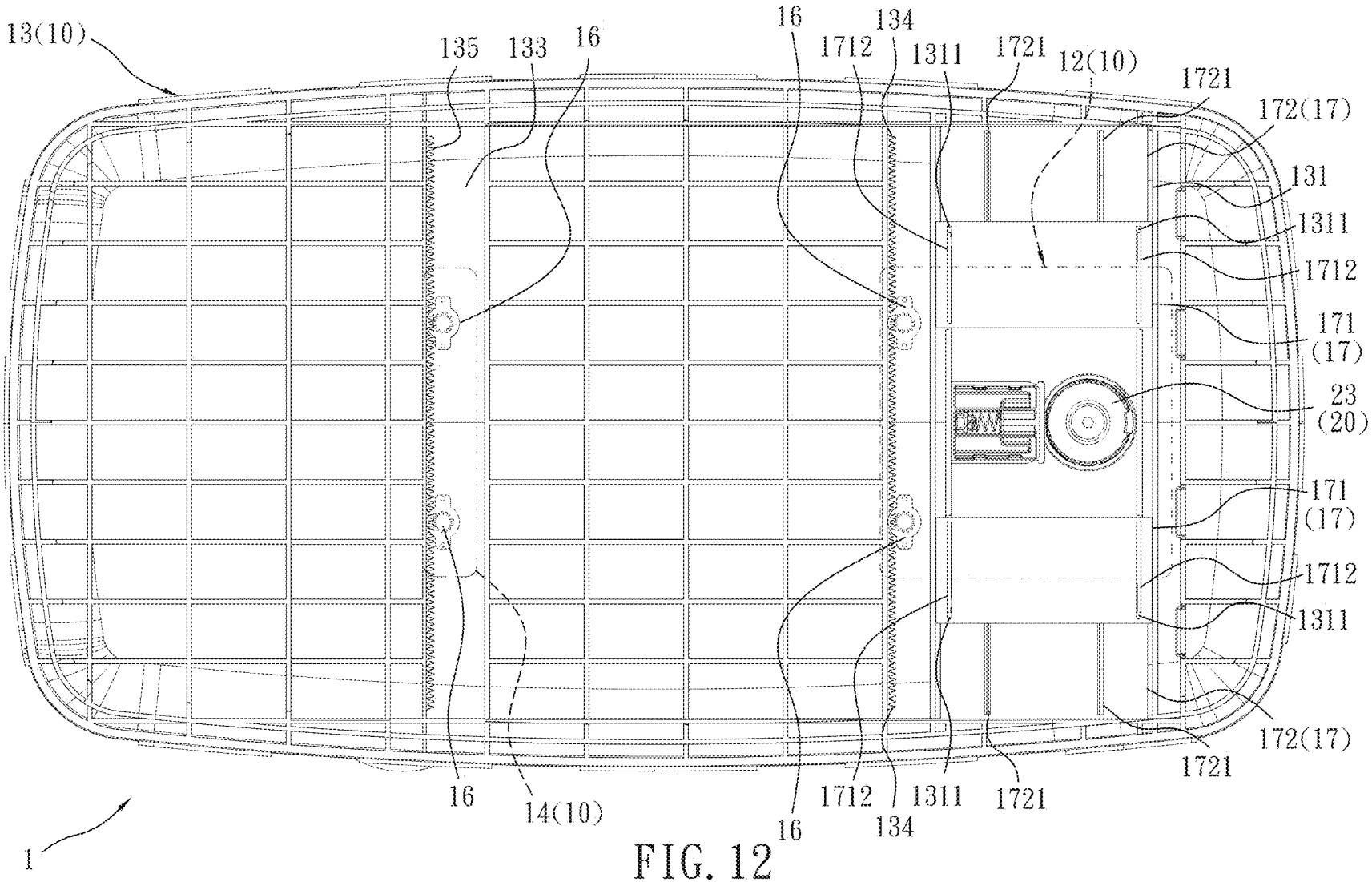
FIG. 12 is a top view of an embodiment of a tablet (in which a top cover and a connection member are removed) according to the present invention.
Figure 13:
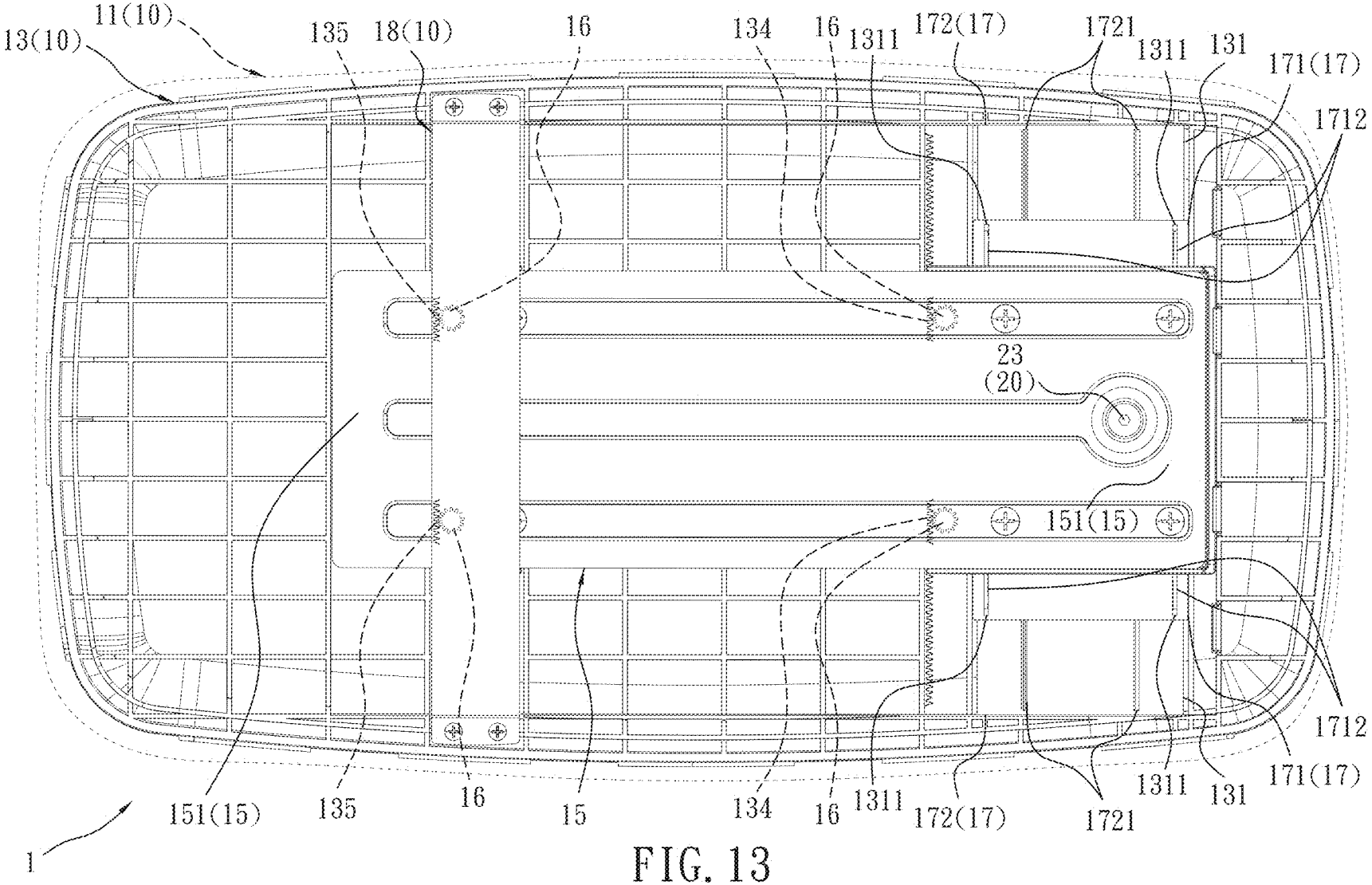
FIG. 13 is a top view of an embodiment of a tablet according to the present invention.
Figure 14:
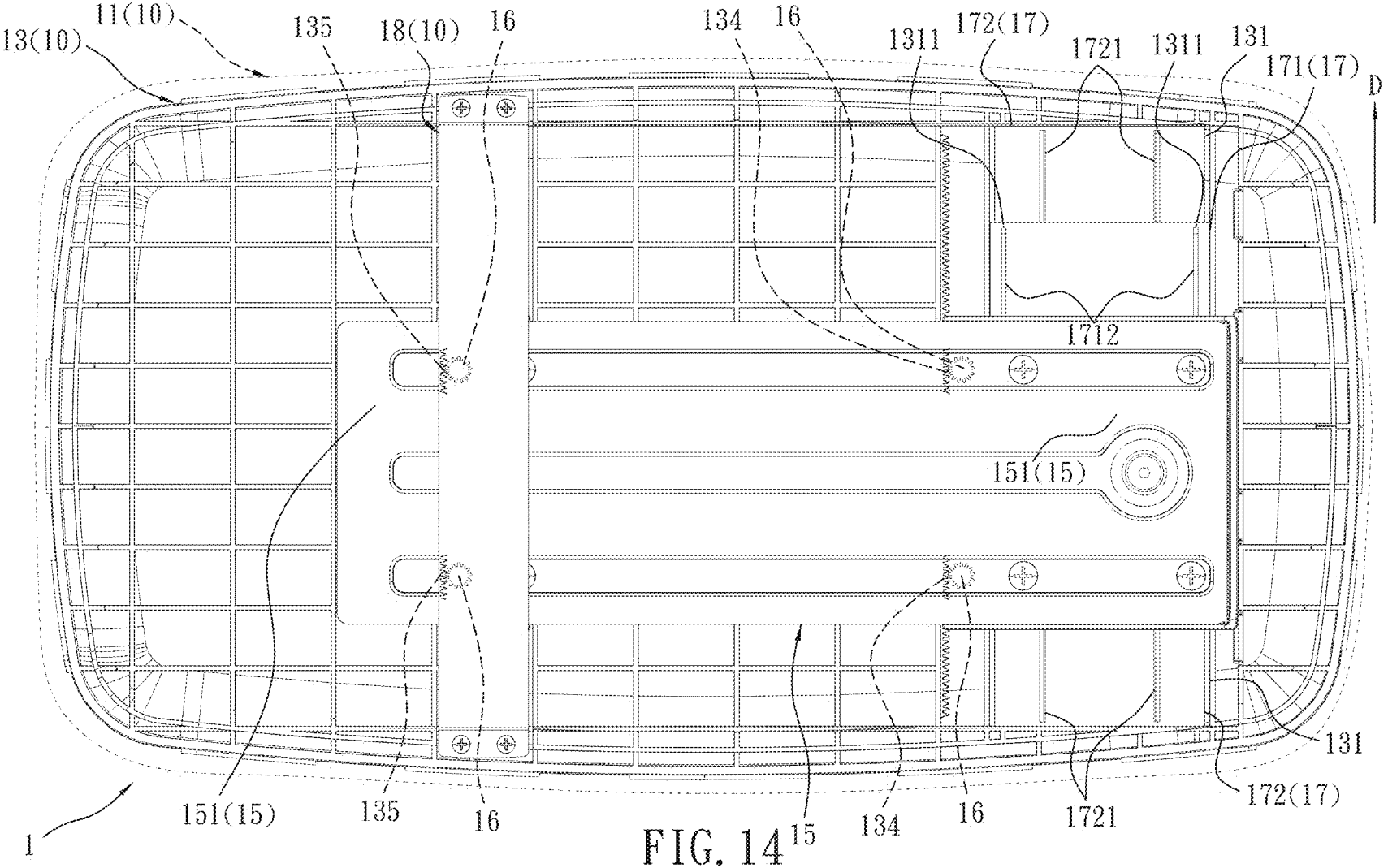
FIG. 14 is a top view of the embodiment in FIG. 13 being moved forward and backward according to the present invention.

Two first sliding blocks 123 are disposed on two ends of each of two opposite sides of the bottom surface of the first slide member 12 in the lengthwise direction of the first slide member 12 and are movably inserted into the first slide-way portions 1711 of the first shield 171 correspondingly from top to bottom, as shown in FIG. 9. Two second sliding blocks 1311 are arranged at two ends of each of two opposite sides of the inner surface of the first sliding slot 131 in the lengthwise direction of the first sliding slot 131 and are movably inserted into the second slide-way portion 1721 of the second shield 172 correspondingly from bottom to top, as shown in FIG. 9. When the first shield 171 and the second shield 172 in one of the two shield sets 17 are driven to slide and extend with respect to each other, the first shield 171 and the second shield 172 in the other shield set 17 are driven to slide and overlap with each other. Thereby the first shield 171 and the second shield 172 of the respective shield sets 17 synchronously slide forward and backward to extend completely or overlap with each other for shielding the insertion hole 132 of the bottom plate 13 when the top cover 11 and the bottom cover 13 are moved forward and backward with respect to the first slide member 12 in the plate member 10, as shown in FIG. 12-14. The above design not only protects users from jammed fingers caused by careless insertion of fingers into the insertion hole 132 while adjusting the tablet 1 but also prevents dirt and objects from falling into the plate member 10.

Refer to FIG. 5 and FIG. 12, the bottom cover 13 of the plate member 10 is further provided with a second sliding slot 133 in parallel with the first sliding slot 131. Refer to FIG. 5 and FIG. 12, the plate member 10 further includes a second slide member 14 and a connection member 15. The second slide member 14 is slidably mounted in the second sliding slot 133 while the connection member 15 has two connecting ends 151 respectively connected to the first slide member 12 and the second slide member 14 so that the first slide member 12 and the second slide member 14 can slide synchronously due to the connection member 15. Refer to FIG. 5 and FIG. 14, the plate member 10 further includes an inner cover 18 which is disposed over the second sliding slot 133 so that the second slide member 14 is able to be limited and sliding between the inner cover 18 and the second sliding slot 133.

The plate member 10 further includes two dampers 16 which are mounted in two symmetrical mounting slots 141 on the second slide member 14 correspondingly, as shown in FIG. 5 and FIG. 14. Each of the dampers 16 is movably engaged with a second rack 135 arranged in the lengthwise direction of the second sliding slot 133 of the bottom cover 13. Thereby the second slide member 14 is able to slide forward and backward relative to the bottom cover 13 of the plate member 10 in the widthwise direction of the bottom cover 13 with damping by the movable engagement of the second rack 135 with the respective dampers 16, as the arrow D indicates in FIG. 14.

The support rod 20 includes an upper end and a lower end extending a certain length downward from the upper end. The upper end forms a rotary shaft 23 that supports the plate member 10 thereover and at least one positioning hole 231 is formed on the rotary shaft 23.

Figure 10:
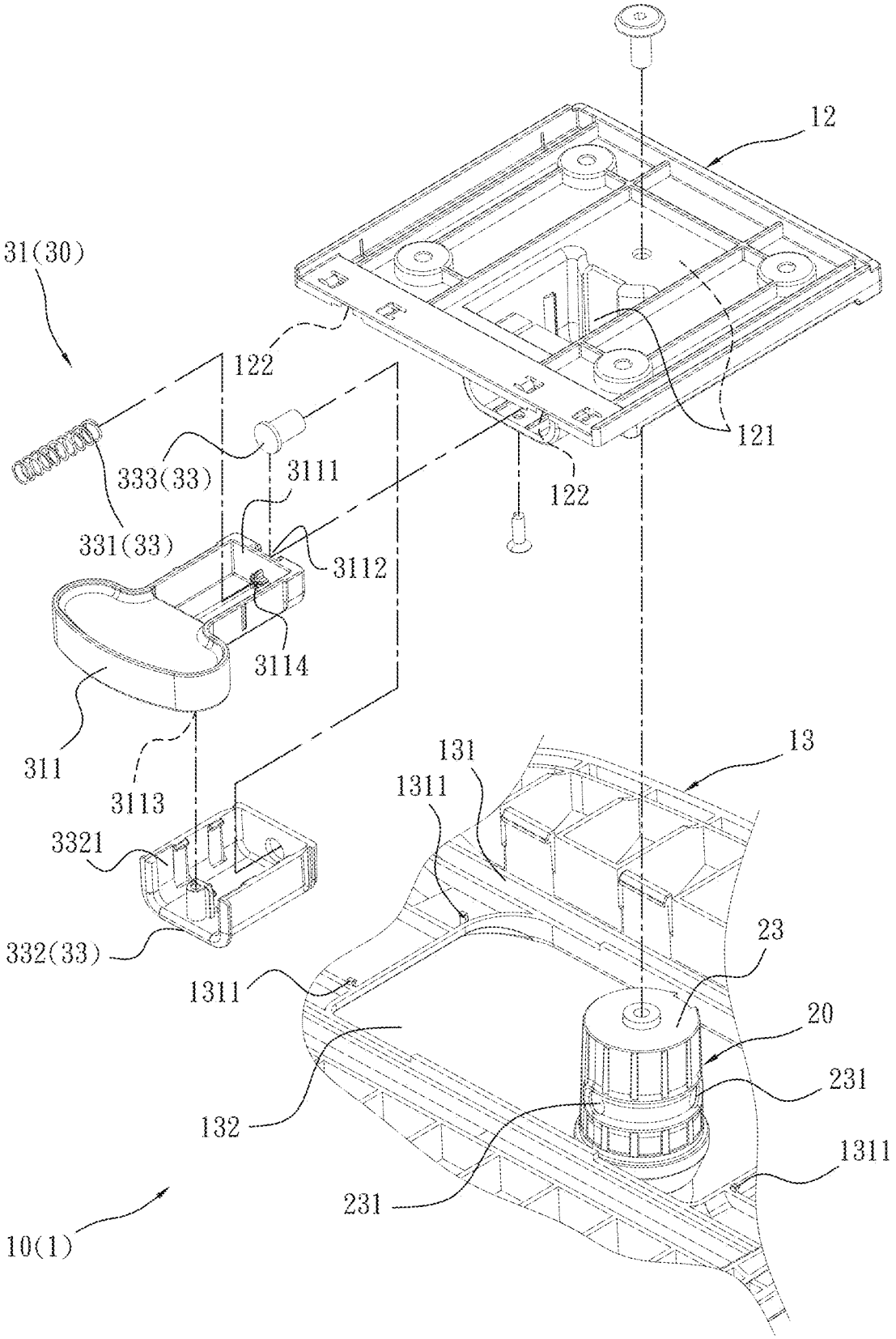
FIG. 10 is a partial enlarged explosive view of an embodiment in which a positioning member is a pull-type fastener according to the present invention.
Figure 15:
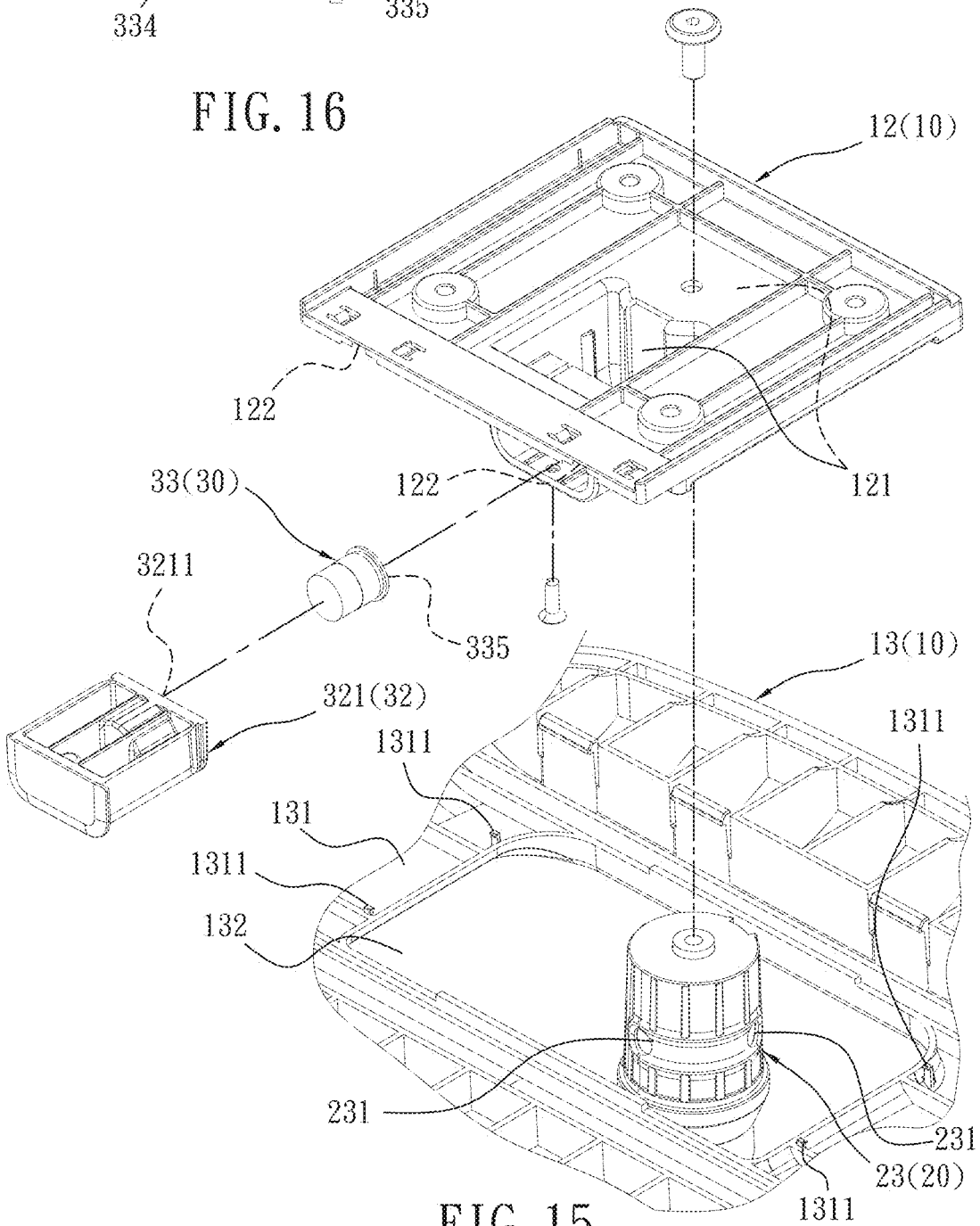
FIG. 15 is a partial enlarged explosive view of an embodiment in which a positioning member is a pull-type fastener according to the present invention.

The positioning member 30 is mounted in the second receiving space 121 of the first slide member 12, as shown in FIG. 10 and FIG. 15, and is provided with a movable locking pin member 33. The movable locking pin member 33 can be operated to be extended and locked into/or retracted and released from the positioning hole 231 on the rotary shaft 23 formed on the upper end of the support rod 20. While the locking pin member 33 is operated to be retracted and released from the positioning hole 231 on the rotary shaft 23 of the support rod 20, the plate member 10 is able to be operated and rotated horizontally for adjusting or selecting the angle of the plate member 10 with respect to the upper end of the support rod 20, as the arrow A indicates in FIG. 1. When the locking pin member 33 is operated to be extended and locked into the positioning hole 231 on the rotary shaft 23 of the support rod 20, the plate member 10 is positioned at the angle relative to the support rod 20 at that time.

Refer to FIG. 1, the plate member 10 is getting close to the chair 2 by the sliding of the first slide member 12 (as the arrow D indicates in FIG. 1) after being rotated horizontally to the right side of the chair 2 by the sleeve 21. The plate member 10 at the moment is parallel to the seat 60 and is in a position/state suitable for right-handers, as shown in FIG. 1. After the plate member 10 is rotated from the above position to the left side of the chair 2 by the sleeve 21 (as the arrow B indicates in FIG. 2), the plate member 10 is moved inward to be closer to the chair 2 by horizontal rotation of the rotary shaft 23 (as the arrow A indicates in FIG. 2). The plate member 10 now is in parallel to the seat 60 and is in a position/state suitable for left-handers, as shown in FIG. 2.

Figure 11:
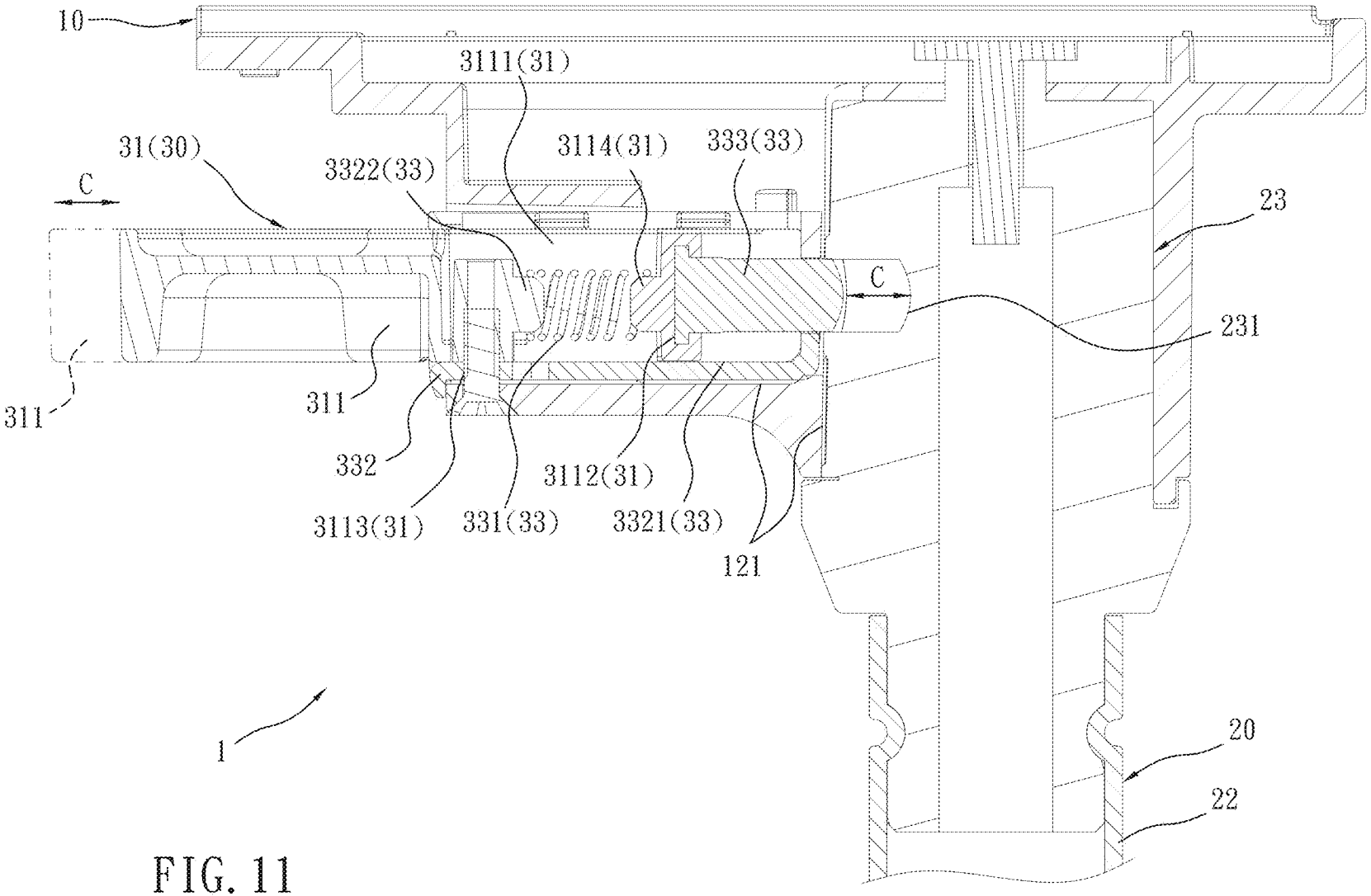
FIG. 11 is a partial enlarged sectional view of an embodiment in which a positioning member is a pull-type fastener according to the present invention.

Refer to FIG. 10 and FIG. 11, the positioning member 30 is a pull-type fastener 31 which includes a pull portion 311. The locking pin member 33 consists of a spring portion 331, an assembly portion 332 and a locking pin 333. The pull portion 311 is formed by a third receiving space 3111 and a locking-pin fixing portion 3112. The third receiving space 3111 is provided with a through hole 3113 and a first locking-and-stopping point 3114 for fixing the spring portion 331 while the locking-pin fixing portion 3112 is for fixing the locking pin 333. The assembly portion 332 has a fourth receiving space 3321 which is provided with a second locking-and-stopping point 3322 and a locking-pin limiting hole 3323. The pull portion 311 is mounted in the fourth receiving space 3321 of the assembly portion 332 while the locking pin 333 is selectively locked into the positioning hole 231 of the rotary shaft 23, as the arrow C indicates in FIG. 11. While being mounted in the assembly portion 332, the pull portion 311 can be pulled so that the locking pin 333 is compressed toward the second locking-and-stopping point 3322 to be moved away from the positioning hole 231 of the rotary shaft 23 by elastic force of the spring portion 331. Or the pull portion 311 can be released so that the locking pin 333 is moved out of the second locking-and-stopping point 3322 to be locked into the positioning hole 231 of the rotary shaft 23 by elastic force of the spring portion 331, as the arrow C indicates in FIG. 11.

Figure 16:
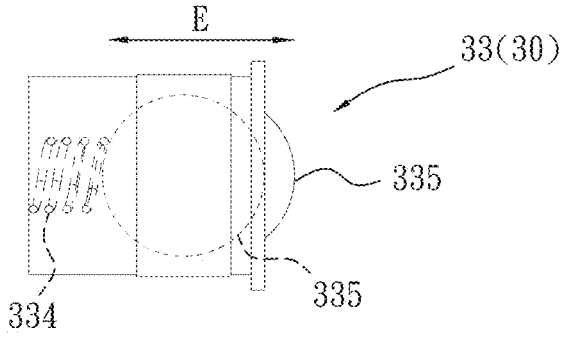
FIG. 16 is a side view of a locking pin member of a positioning member of the embodiment in FIG. 15 according to the present invention.
Figure 17:
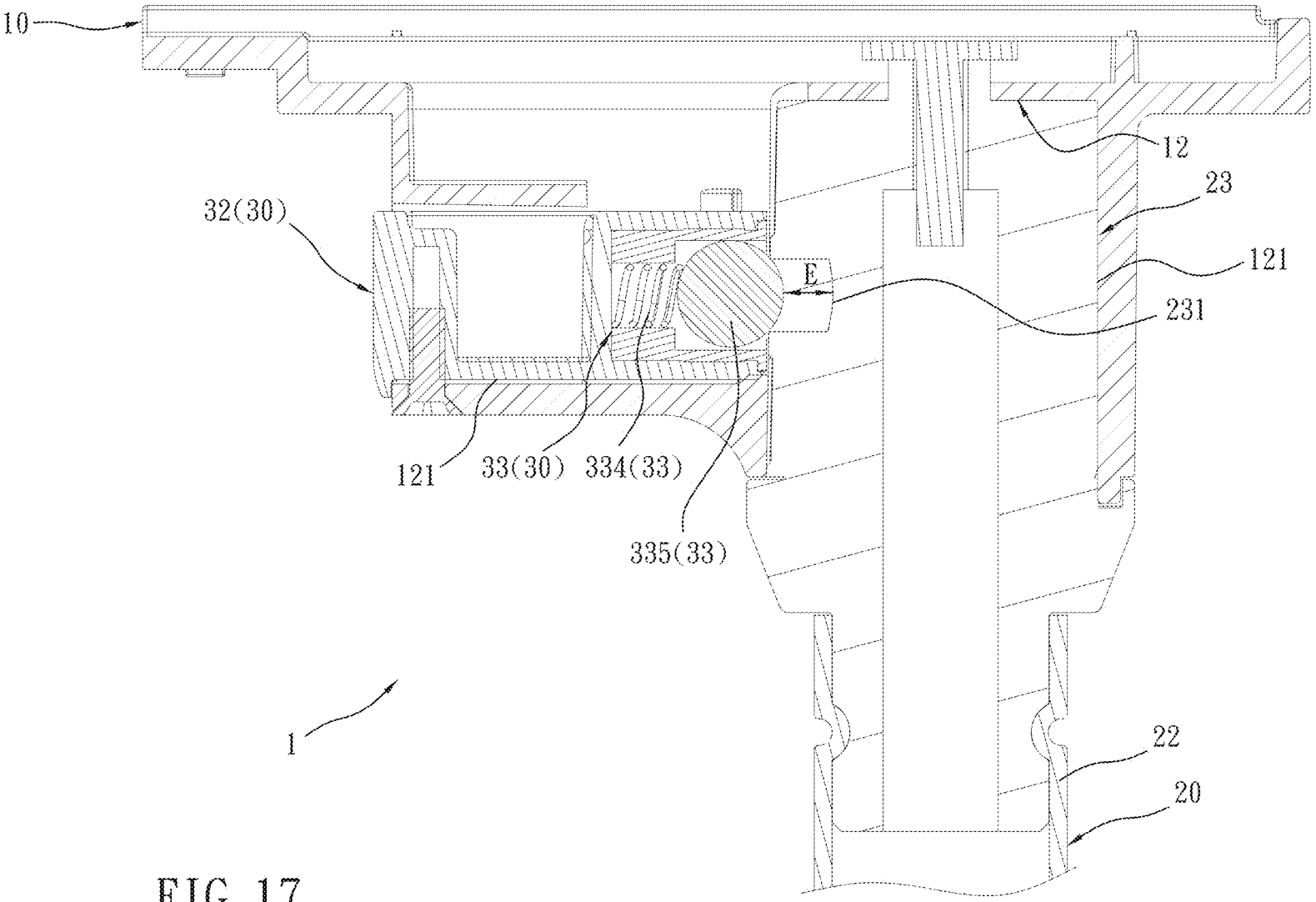
FIG. 17 is a partial enlarged sectional view of an embodiment in which a positioning member is an automatic fastener according to the present invention.
Figure 18:
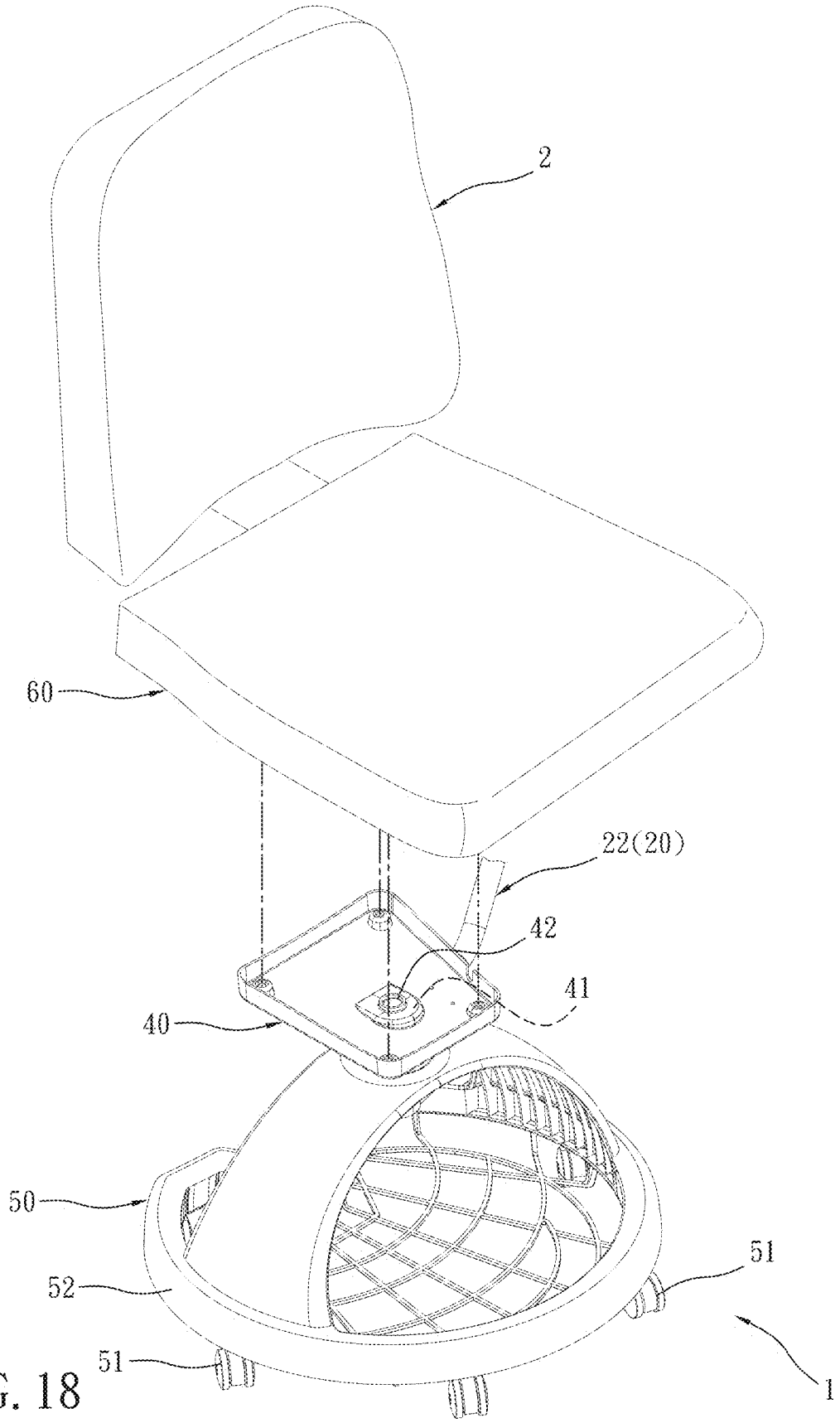
FIG. 18 is an explosive view of the chair of the embodiment in FIG. 2 being moved according to the present invention.
Figure 19:
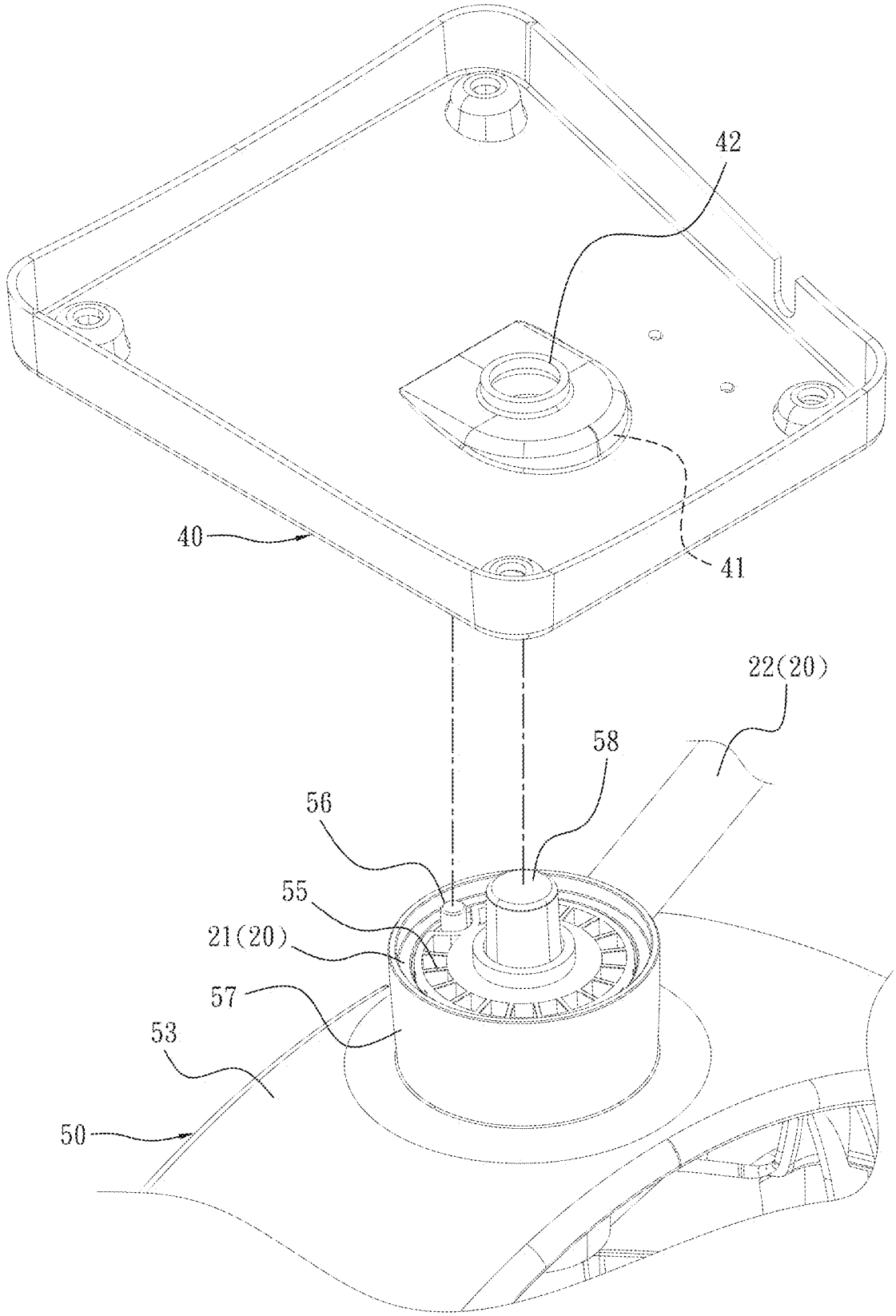
FIG. 19 is a partial explosive view of the embodiment in FIG. 18 in which a seat fixing member is removed from a pneumatic rod according to the present invention.

In the embodiment shown in FIG. 15-17, the positioning member 30 is an automatic fastener 32 provided with an assembly portion 321 while the locking pin member 33 further includes a spring 334 and a locking ball 335. The assembly portion 321 further includes a locking-pin assembly part 3211 used for mounting the locking pin member 33 therein. The locking ball 335 can be pressed into the locking pin member 33 or come out of the locking pin member 33 by elastic force of the spring 334. The locking ball 335 is selectively locked into the positioning hole 231 of the rotary shaft 23, as the arrow E indicates in FIG. 17. While being mounted in the assembly portion 321, the locking pin member 33 is rotated along with the rotating first slide member 12 being rotated so that the locking ball 335 is pressed into the locking pin member 33 to be moved away from the positioning hole 231 of the rotary shaft 23 by elastic force of the spring 334 of the locking pin member 33. Or the plate member 10 is rotated so that the locking ball 335 is moved out of the locking pin member 33 to be locked into the positioning hole 231 of the rotary shaft 23 by elastic force of the spring 334 of the locking pin member 33, as the arrow E indicates in FIG. 17.

Figure 20:
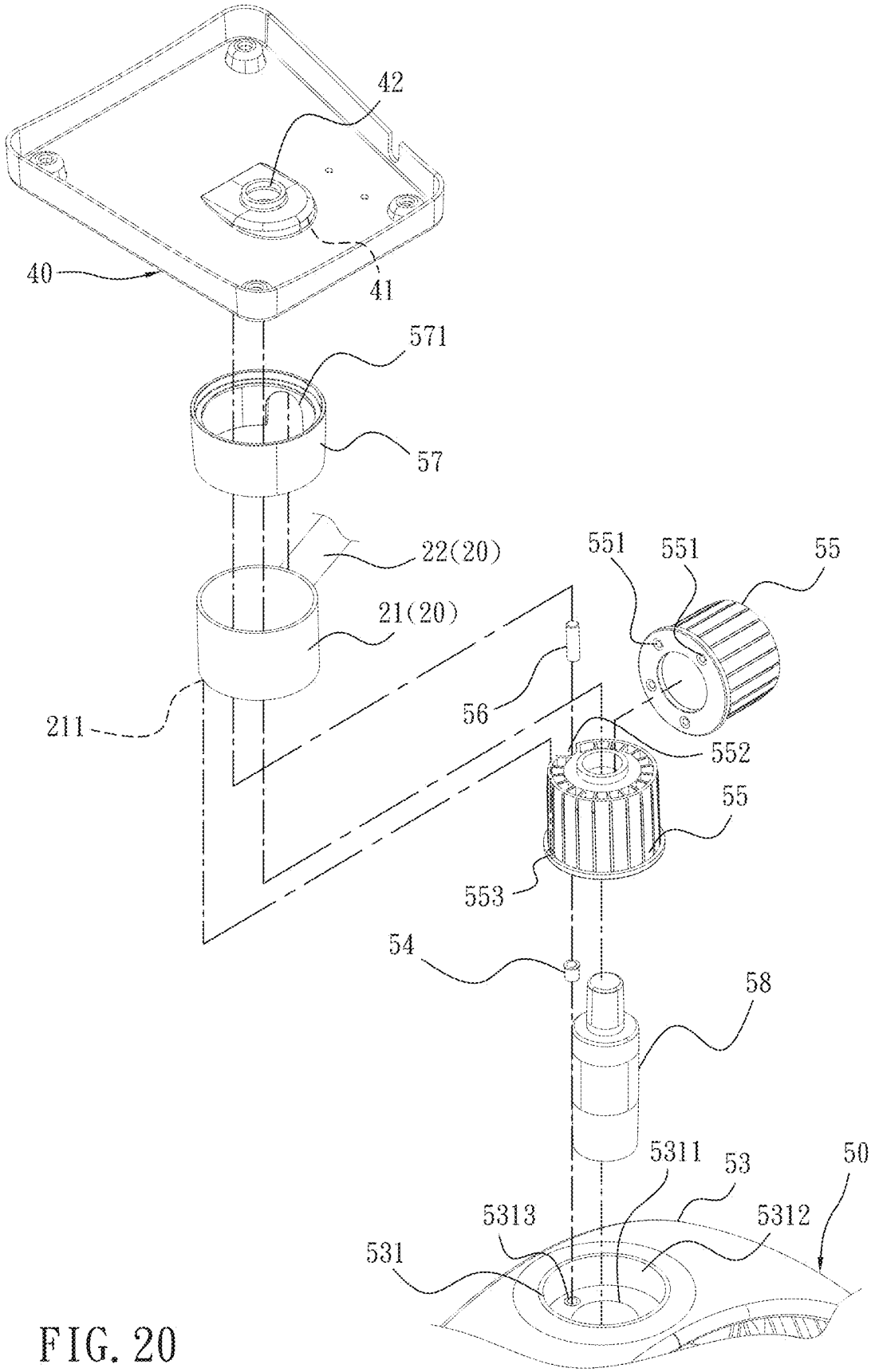
FIG. 20 is a partial enlarged explosive view of a seat fixing member, an outer bushing, a support rod, a limit bar, an inner bearing, an elastic member, a pneumatic rod and a support of the embodiment in FIG. 19 according to the present invention.
Figure 21:
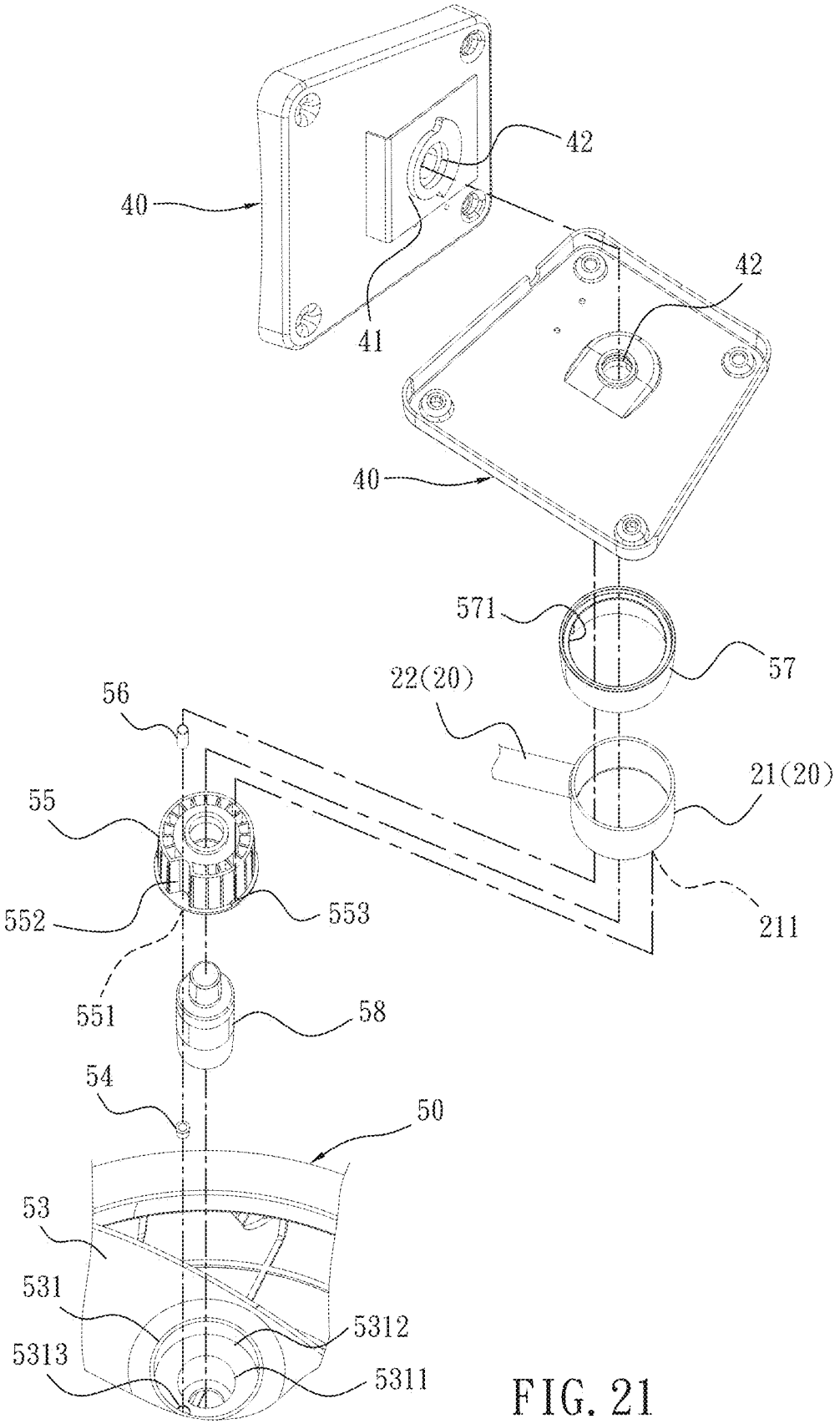
FIG. 21 is a schematic drawing of the embodiment in FIG. 20 viewed from another angle according to the present invention.

Refer to FIGS. 18-22 and FIG. 27, a seat fixing member 40 is disposed under the seat 60 and is composed of a limit rotating groove 41 for limiting the angle of the plate member 10 to be rotated horizontally around the chair 2 within 180° and a mounting hole 42. Both the limit rotating groove 41 and the mounting hole 42 are arranged at the bottom of the seat fixing member 40. From bottom to top, the chair base 50 includes a plurality of caster sets 51, a circular frame base 52, a support 53, an elastic member 54, an inner bearing 55, a limit bar 56, an outer bushing 57 and a pneumatic rod 58. As shown in FIG. 20, the support 53 is provided with a fifth receiving space 531 while a pneumatic rod hole 5311, a bearing hole 5312 and an elastic member hole 5313 are formed in the fifth receiving space 531. The pneumatic rod hole 5311 is for mounting the pneumatic rod 58 and the elastic member 54 is mounted in the elastic member mounting hole 5313 of the support 53 while the inner bearing 55 is arranged in the bearing hole 5312 of the support 53 and disposed around the pneumatic rod 58. At least one fixing part 551 is disposed on the bottom of the inner bearing 55 for fixing the elastic member 54 at a certain angle and a limit fixing part 552 is arranged at the surface of the inner bearing 55. A locking part 553 is mounted on one side of the inner bearing 55 so that the inner bearing 55 and the sleeve 21 are connected by the locking part 553 of the inner bearing 55 being locked with a locked portion on the sleeve 21. A lower part of the limit bar 56 is disposed in the limit fixing part 552 of the inner bearing 55 while an upper part of the limit bar 56 is inserted through the sleeve 21 and the outer bushing 57 to abut against the limit rotating groove 41 of the seat fixing member 40. The outer bushing 57 is arranged between the bearing hole 5312 and the limit rotating groove 41 of the seat fixing member 40 while the sleeve 21, the inner bearing 55, and the pneumatic rod 58 are mounted in the outer bushing 57. The outer bushing 57 has a locking notch 571 with an opening facing downward, by which the outer bushing 57 is locked and stopped on a connection area between the sleeve 21 and the rod member 22.

Figure 22:
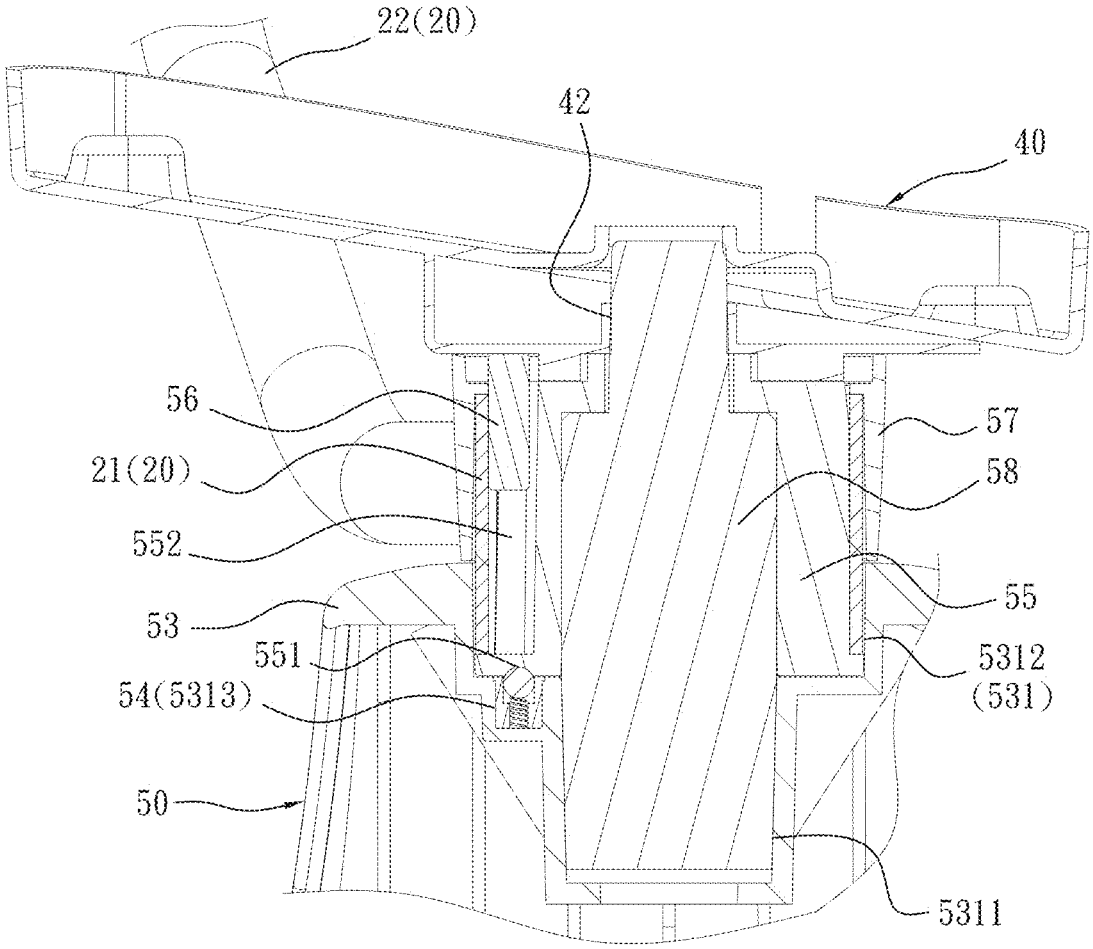
FIG. 22 is a partial enlarged side view of a section of the embodiment in FIG. 18 (without chair) according to the present invention.
Figure 25:
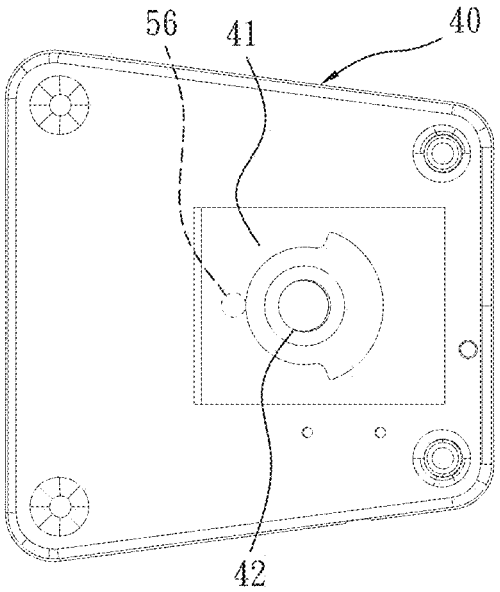
FIG. 25 is a top view of a seat fixing member (with a limit bar) in an embodiment according to the present invention.
Figure 26:
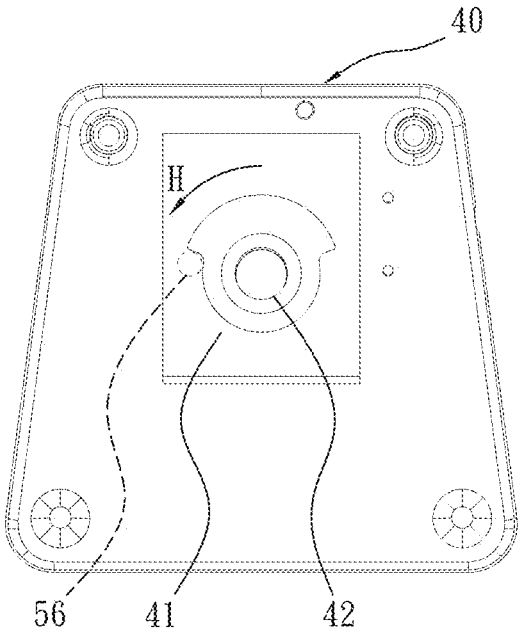
FIG. 26 is the embodiment in FIG. 25 rotated an angle according to the present invention.
Figure 27:
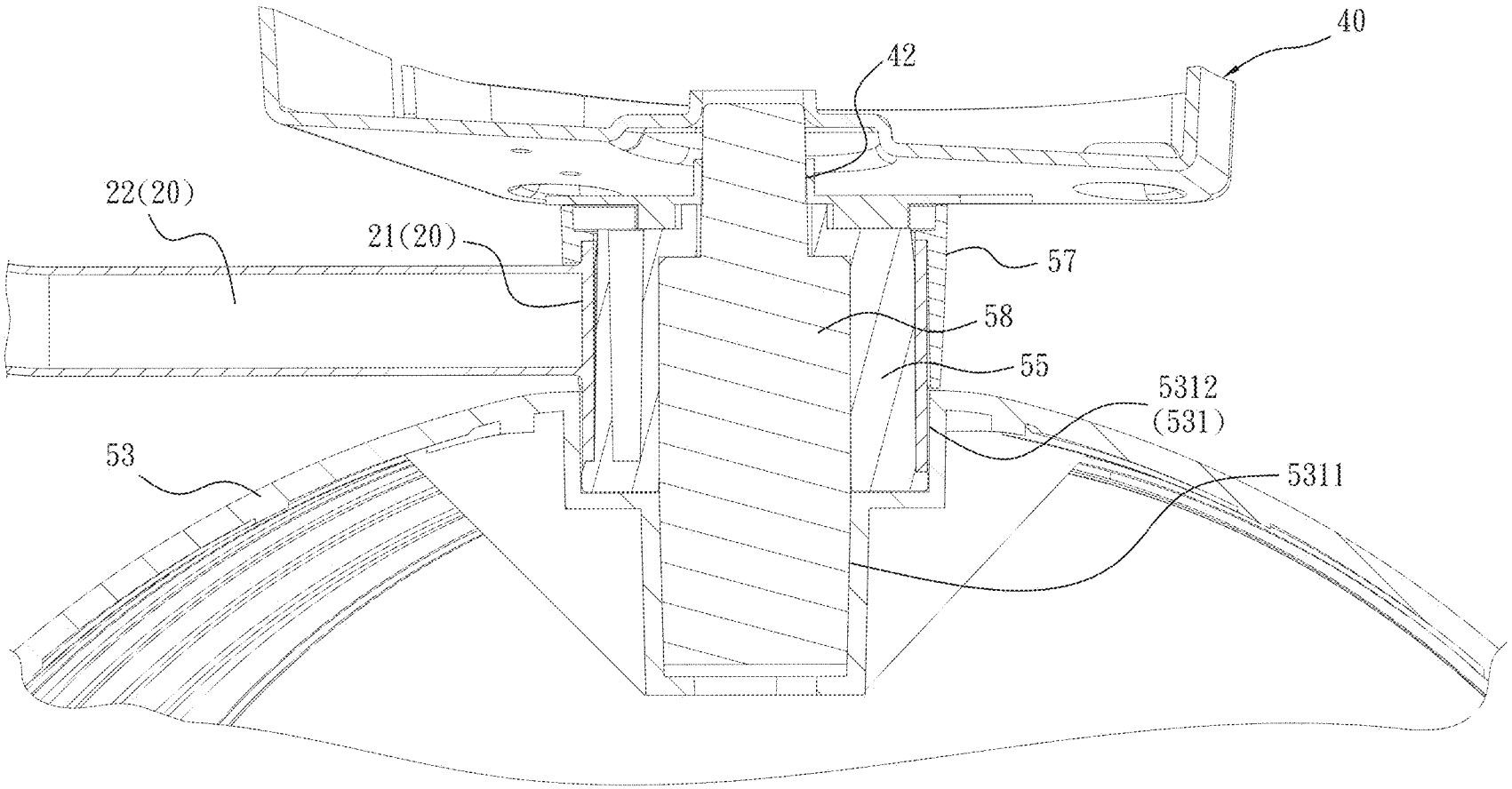
FIG. 27 is a partial enlarged side view of a section of the embodiment in FIG. 18 (without chair) viewed from another angle according to the present invention.

Refer to FIG. 22, FIG. 25 and FIG. 26, while the pneumatic rod 58 remaining still, the seat fixing member 40 can be rotated no more than 180 degrees horizontally over the pneumatic rod 58 due to position limit between the limit rotating groove 41 and the limit bar 56, as the arrow H indicates in FIG. 26.

Figure 23:
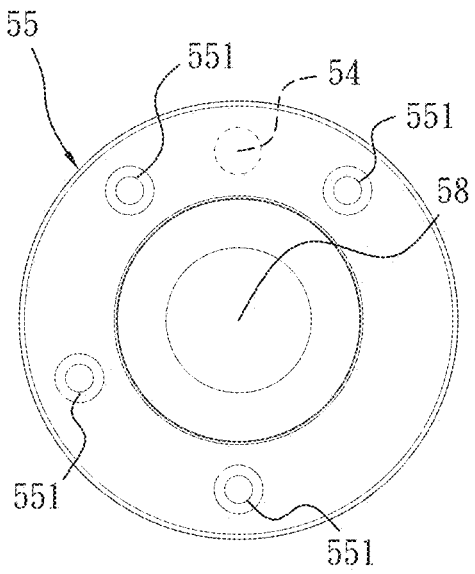
FIG. 23 is a bottom view of an inner bearing (with an elastic member) in an embodiment of the present invention.
Figure 24:
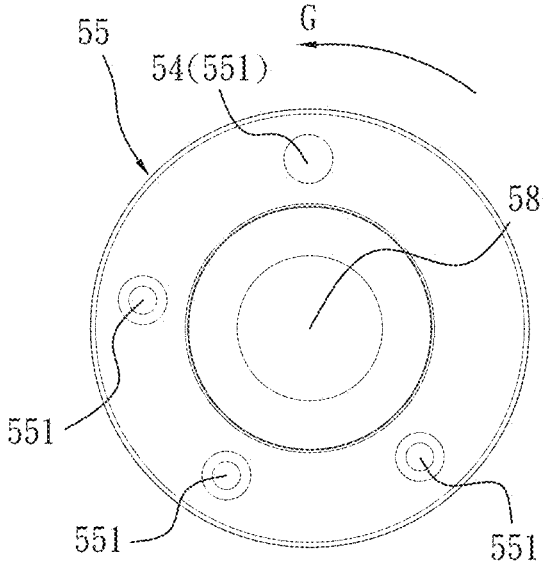
FIG. 24 is the embodiment in FIG. 23 rotated an angle according to the present invention.

Refer to FIG. 22, FIG. 23 and FIG. 24, the elastic member 54 can make the inner bearing 55, the sleeve 21, and the outer bushing 57 to be in a fastened state in which the sleeve 21 is unable to be rotated (as shown in FIG. 23) or a rotatable state in which the sleeve 21 is able to be rotated (as the arrow G indicates in FIG. 24). When the pneumatic rod 58 is still and the sleeve 21 is rotatable, the bearing 55, the sleeve 21, and the outer bushing 57 can be rotated a certain angle horizontally relative to the pneumatic rod 58, as the arrow G indicates in FIG. 24.

Figure 28:
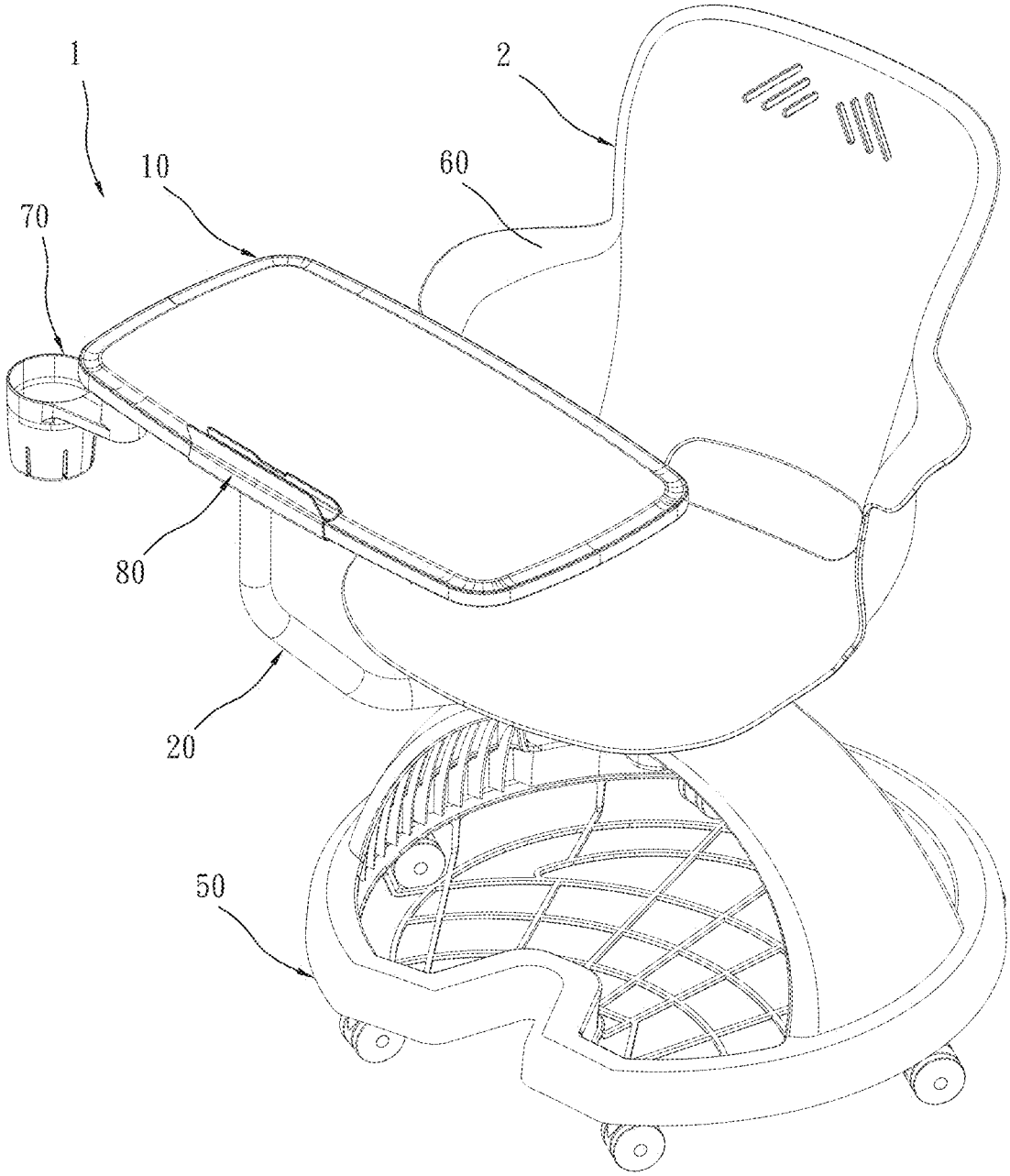
FIG. 28 is a perspective view of an embodiment (further provided with a drink holder and an object clip) according to the present invention.

The support rod 20 can be assembled with a pneumatic rod of various types of chairs by the sleeve 21 so that chairs originally having no tablet can be added with the tablet for use. Thus users don't need to buy the whole set of chair with the tablet in the beginning so that they can spend less money on the chair. As shown in FIG. 1 and FIG. 28, the t plate member 10 can be arranged at different types of chairs by the support rod 20.

Figure 29:
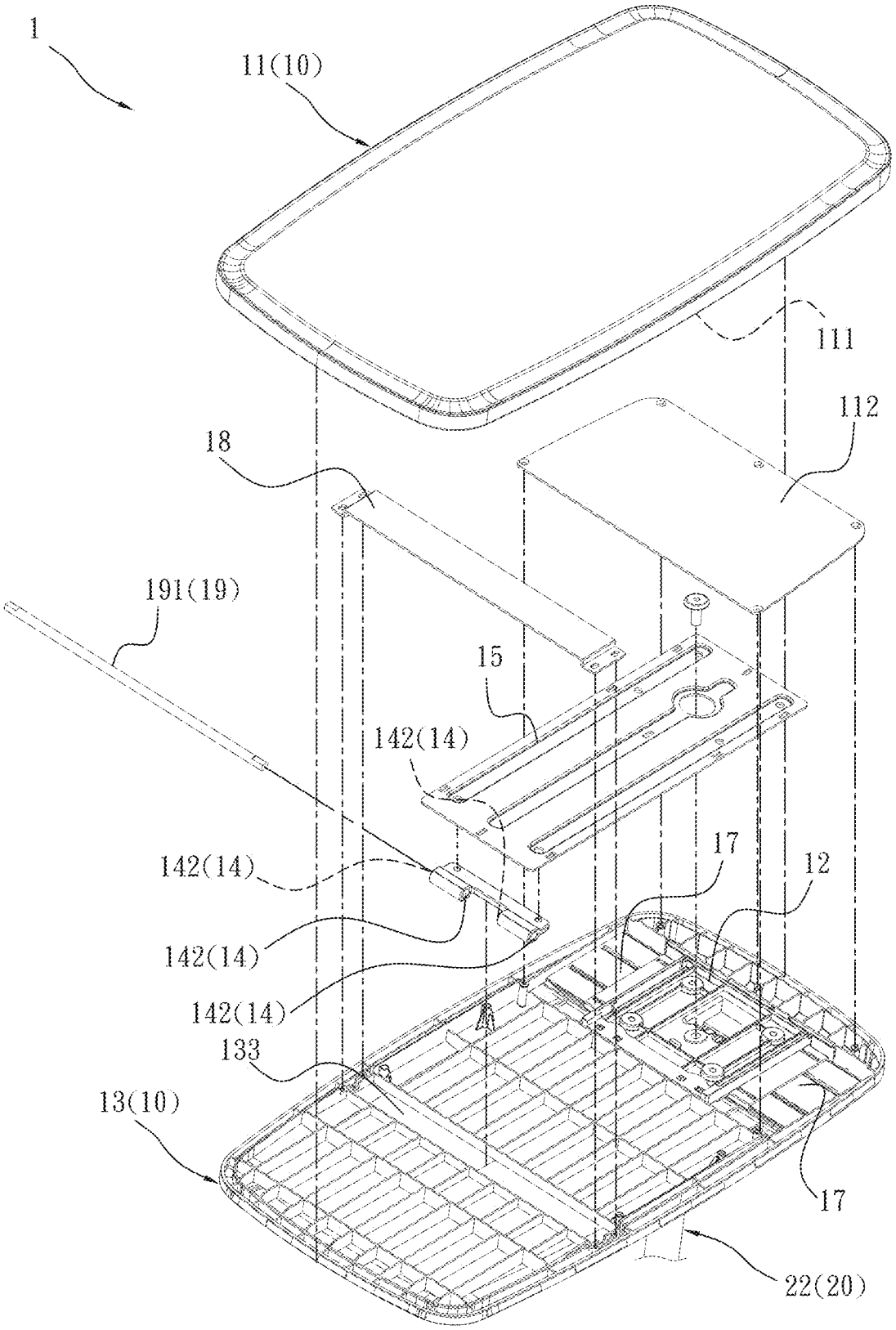
FIG. 29 is an explosive view of another embodiment (with a sliding rod and a loading plate) according to the present invention.

Refer to FIG. 29, the second sliding slot 133 of the plate member 10 further includes a sliding rod 19 therein. A rod portion 191 of the sliding rod 19 is inserted into a rail portion 142 of the second slide member 14 so that the sliding rod 19 allows the second slide member 14 to slide along the rod portion 191 of the sliding rod 19 in a particular direction.

Refer to FIG. 28, the plate member 10 is further provided with a drink holder 70 and an object clip 80. The object clip further includes a document holder or an electronic-device holder. The document holder can also holds books while the electronic-device holder can hold electronic devices such as tablet computers. Thus users don't need to use their hands while working on paperwork and they feel more comfortable.

Refer to FIG. 29, a loading plate 112 is mounted in the first receiving space 111 of the top cover 11 and located between the top cover 11 and the bottom cover 13 for increasing support force provided by the top cover 11. Thus the plate member 10 can still work well while being pressed by the user's hands.

In addition, a connection portion 25 is designed to form at the lower end of the support rod 20. By the connection portion 25, the plate member 10 can be assembled with a base 24 arranged at a leg of the bed 3 (as shown in FIG. 30), the sofa 4 (as shown in FIG. 31), the table 5 (as shown in FIG. 32), the tray with wheels 6 (as shown in FIG. 33) or the multi-seater chair 7 (as shown in FIG. 34). Thereby the tablet 1 can be adjusted to the position the user requires by being rotated around the base 24, as shown in FIG. 30-34. By sliding of the first slide member 12, the distance between the plate member 10 and the chair 2, the sofa 4, the table 5, the tray with wheels 6 or the multi-seater chair 7 can be adjusted.

Compared with the techniques available now, the tablet 1 of the present invention has the following advantages:

(1) The present tablet 1 can be disposed on the chair 2, the bed 3 (as shown in FIG. 30), the sofa 4 (as shown in FIG. 31), the table 5 (as shown in FIG. 32), the tray with wheels 6 (as shown in FIG. 33) or the multi-seater chair 7 (as shown in FIG. 34). Thus the applications of the tablet 1 are increased and this is beneficial to both manufacturers and consumers.

(2) By the movable engagement of the first rack 134 with the respective dampers 16, the top cover 11 and the bottom cover 13 of the plate member 10 are able to slide with respect to the first slide member 12 with damping. The friction generated during the sliding is relatively reduced. Thus consumers or users can operate the tablet 1 more conveniently and the respective components of the tablet 1 are resistant to damage due to the reduced (3) The plate member 10 of the present tablet 1 can be moved and rotated horizontally around the chair 2 or other furniture by the sleeve 21 of the support rod 20. Then users can position the tablet 1 at a certain angle or position they need after the adjustment.

(4) The plate member 10 can rotate by the sleeve 21. The structure design of the components is simple so that the tablet 1 is more durable. The simple design not only optimizes the assembly operation no matter at the manufacturer side or at the consumer side but also reduces the production cost.

The above description is only the preferred embodiments of the present invention and is not intended to limit the present invention in any form. Although the invention has been disclosed as above in the preferred embodiments, they are not intended to limit the invention. A person skilled in the relevant art will recognize that equivalent embodiment modified and varied as equivalent changes disclosed above can be used without parting from the scope of the technical solution of the present invention. All the simple modification, equivalent changes and modifications of the above embodiments according to the material contents of the invention shall be within the scope of the technical solution of the present invention.

What is claimed is:

1. A tablet comprising:

a plate member, a support rod, and a positioning member;

wherein the support rod includes an upper end and a lower end extended downward from the upper end for a certain length; the upper end which forms a rotary shaft is used for supporting the plate member over the upper end and at least one positioning hole is disposed on the rotary shaft;

wherein the plate member includes a top cover, a first slide member, and a bottom cover; the top cover and the bottom cover are arranged vertically and assembled with each other to form one part which is moved forward and backward with respect to the first slide member in a widthwise direction of the plate member; the top cover has a first receiving space for mounting the first slide member and the bottom cover while the first slide member is provided with a second receiving space; the bottom cover is provided with a first sliding slot disposed widthwise and a long insertion hole arranged at a bottom of the first sliding slot in a widthwise direction of the bottom cover; the first slide member is able to slide forward and backward in the first sliding slot in the widthwise direction of the plate member; wherein the rotary shaft formed on the upper end of the support rod is inserted through the insertion hole of the bottom cover from bottom to top to be connected to and fixed on the first slide member;

wherein the plate member further includes at least one damper which is mounted in a mounting slot on the first slide member and the damper is movably engaged with a first rack arranged along the first sliding slot of the bottom cover; thus the top cover and the bottom cover of the plate member are able to slide forward and backward with respect to the first slide member of the plate member with damping by the movable engagement of the first rack with the damper;

wherein the plate member further includes two shield sets which are located between the first slide member and the first sliding slot of the bottom cover and are respectively disposed lengthwise on two ends of the first sliding slot, symmetrical to each other; the shield sets can be moved forward and backward to cover the insertion hole of the bottom cover under the shield sets; each of the shield sets is composed of a first shield and a second shield; the first shield has a first slide-way portion and a first slide rail portion while the second shield has a second slide-way portion and a second slide rail portion; the first slide rail portion of the first shield is movably connected to the second slide rail portion of the second shield so that the first shield and the second shield can slide with respect to each other for being extended or overlapped; wherein two first sliding blocks are disposed on two ends of each of two opposite sides of a bottom surface of the first slide member lengthways and are movably inserted into the first slide-way portions of the first shield correspondingly from top to bottom; two second sliding blocks are arranged at two ends of each of two opposite sides of an inner surface of the first sliding slot lengthways and are movably inserted into the second slide-way portion of the second shield correspondingly from bottom to top; when the first shield and the second shield in one of the two shield sets are driven to slide and extend with respect to each other, the first shield and the second shield in the other shield set are driven to slide and overlap with each other; thereby the first shield and the second shield of the respective shield sets synchronously slide forward/backward to extend completely or overlap with each other for shielding the insertion hole of the bottom plate when the top cover and the bottom cover are moved forward/backward with respect to the first slide member in the plate member;

wherein the positioning member is mounted in the second receiving space of the first slide member and is provided with a movable locking pin member; the movable locking pin member can be operated to be either extended and locked into or retracted and released from the positioning hole on the rotary shaft formed on the upper end of the support rod; wherein the plate member can be operated and rotated horizontally for adjusting or selecting an angle of the plate member with respect to the upper end of the support rod while the locking pin member is operated to be retracted and released from the positioning hole on the rotary shaft of the support rod; wherein the plate member is positioned at an angle relative to the support rod when the locking pin member is operated to be extended and locked into the positioning hole on the rotary shaft of the support rod.

2. The tablet as claimed in claim 1, wherein the bottom cover of the plate member is further provided with a second sliding slot in parallel with the first sliding slot; wherein the plate member further includes a second slide member and a connection member while the second slide member is slidably mounted in the second sliding slot and the connection member has two connecting ends respectively connected to the first slide member and the second slide member so that the first slide member and the second slide member are able to slide synchronously due to the connection member.

3. The tablet as claimed in claim 2, wherein the plate member further includes an inner cover which is disposed over the second sliding slot so that the second slide member is able to be limited and sliding between the inner cover and the second sliding slot.

4. The tablet as claimed in claim 3, wherein the second sliding slot of the plate member further includes a sliding rod therein; wherein a rod portion of the sliding rod is inserted into a rail portion of the second slide member so that the sliding rod allows the second slide member to slide along the rod portion of the sliding rod in a particular direction.

5. The tablet as claimed in claim 3, wherein the plate member further includes two dampers which are mounted in two symmetrical mounting slots on the second slide member correspondingly; each of the dampers is movably engaged with a second rack arranged lengthwise in the second sliding slot of the bottom cover; thereby the second slide member is able to slide forward and backward relative to the bottom cover of the plate member widthwise with damping by the movable engagement of the second rack with the respective dampers.

6. The tablet as claimed in claim 1, wherein the positioning member is a pull-type fastener which includes a pull portion; wherein the locking pin member includes a spring portion, a first assembly portion and a locking pin; wherein the pull portion is provided with a third receiving space and a locking-pin fixing portion while the third receiving space is provided with a through hole and a first locking-and-stopping point for fixing the spring portion while the locking-pin fixing portion is for fixing the locking pin; the first assembly portion has a fourth receiving space which is provided with a second locking-and-stopping point and a locking-pin limiting hole; wherein the pull portion is mounted in the fourth receiving space of the first assembly portion; wherein the locking pin is selectively locked into the positioning hole of the rotary shaft; wherein while being mounted in the first assembly portion, the pull portion can be pulled so that the locking pin is compressed toward the second locking-and-stopping point to be moved away from the positioning hole of the rotary shaft by elastic force of the spring portion; wherein the pull portion can be released so that the locking pin is moved out of the second locking-and-stopping point to be locked into the positioning hole of the rotary shaft by elastic force of the spring portion.

7. The tablet as claimed in claim 1, wherein the positioning member is an automatic fastener provided with a second assembly portion while the locking pin member further includes a spring and a locking ball; wherein the second assembly portion includes a locking-pin assembly part used for mounting the locking pin member therein; wherein the locking ball is able to be pressed into the locking pin member or come out of the locking pin member by elastic force of the spring; wherein the locking ball is selectively locked into the positioning hole of the rotary shaft; wherein while being mounted in the second assembly portion, the locking pin member is rotated along with the rotating first slide member being rotated so that the locking ball is pressed into the locking pin member to be moved away from the positioning hole of the rotary shaft by elastic force of the spring of the locking pin member; or the plate member is rotated so that the locking ball is moved out from the locking pin member to be locked into the positioning hole of the rotary shaft by elastic force of the spring of the locking pin member.

8. The tablet as claimed in claim 1, wherein a sleeve is formed on the lower end of the support rod while a rod member is disposed between the sleeve and the rotary shaft; wherein the sleeve is pivotally connected to a lower part of a chair so that the plate member is able to be horizontally rotated an angle around the chair; wherein a distance between the plate member and the chair is able to be adjusted by sliding of the first slide member when the plate member is rotated horizontally to be close to the chair by the sleeve.

9. The tablet as claimed in claim 8, wherein the lower part of the chair further includes a seat and a chair base; wherein the seat is supported by the chair base; wherein the support rod is rotatably disposed between the chair base and the seat for left-handers or right-handers to use; wherein the sleeve is pivotally connected to the chair base of the chair so that the support rod is rotatable with respect to the chair base; wherein the chair base is arranged at the lower part of the chair for supporting the plate member and the chair.

10. The tablet as claimed in claim 9, wherein a seat fixing member is disposed under the seat; a bottom of the seat fixing member is provided with a limit rotating groove and a mounting hole; the limit rotating groove is used for limiting the angle of the plate member to be horizontally rotated around the chair within 180 degrees.

11. The tablet as claimed in claim 10, wherein the chair base includes a plurality of caster sets, a circular frame base, a support, an elastic member, an inner bearing, a limit bar, an outer bushing and a pneumatic rod from bottom to top; wherein the support is provided with a fifth receiving space while a pneumatic rod hole, a bearing hole and an elastic member hole are formed in the fifth receiving space; the pneumatic rod hole is for mounting the pneumatic rod and the elastic member is mounted in the elastic member mounting hole of the support while the inner bearing is arranged in the bearing hole of the support and disposed around the pneumatic rod; at least one fixing part is disposed on a bottom of the inner bearing for fixing the elastic member at an angle and a limit fixing part is arranged at a surface of the inner bearing; a locking part is mounted on one side of the inner bearing so that the inner bearing and the sleeve are connected by the locking part of the inner bearing being locked with a locked portion on the sleeve; wherein a lower part of the limit bar is disposed in the limit fixing part of the inner bearing while an upper part of the limit bar is inserted through the sleeve and the outer bushing to abut against the limit rotating groove of the seat fixing member; wherein the outer bushing is arranged between the bearing hole and the limit rotating groove of the seat fixing member while the sleeve, the inner bearing, and the pneumatic rod are mounted in the outer bushing; the outer bushing has a locking notch with an opening facing downward, by which the outer bushing is locked and stopped on a connection area between the sleeve and the rod member.

12. The tablet as claimed in claim 11, wherein the seat fixing member is able to be rotated no more than 180 degrees horizontally over the pneumatic rod due to position limit between the limit rotating groove and the limit bar when the pneumatic rod is still.

13. The tablet as claimed in claim 12, wherein the elastic member makes the inner bearing, the sleeve, and the outer bushing to be in either a fastened state in which the sleeve is unable to be rotated or a rotatable state in which the sleeve is able to be rotated.

14. The tablet as claimed in claim 13, wherein the inner bearing, the sleeve, and the outer bushing are able to be rotated an angle horizontally relative to the pneumatic rod when the pneumatic rod is still and the sleeve is rotatable.

15. The tablet as claimed in claim 1, wherein a connection portion is formed at the lower end of the support rod; wherein the plate member is able to be assembled with a base arranged at a leg of a bed, a sofa, a table, a tray with wheels or a multi-seater chair by the connection portion of the support rod; wherein a distance between the plate member and the chair, the sofa, the table, the tray with wheels or the multi-seater chair is able to be adjusted by sliding of the first slide member.

* * * * *